US008704644B2

(12) United States Patent
Uno

(10) Patent No.: US 8,704,644 B2
(45) Date of Patent: Apr. 22, 2014

(54) REMOTE CONTROL SYSTEM, REMOTE CONTROL APPARATUS AND REMOTE CONTROL METHOD

(75) Inventor: Hiroyuki Uno, Tokyo (JP)

(73) Assignee: NEC Corporation, Tokyo (JP)

( * ) Notice: Subject to any disclaimer, the term of this patent is extended or adjusted under 35 U.S.C. 154(b) by 183 days.

(21) Appl. No.: 13/502,915

(22) PCT Filed: Oct. 14, 2010

(86) PCT No.: PCT/JP2010/068531

§ 371 (c)(1),
(2), (4) Date: Apr. 19, 2012

(87) PCT Pub. No.: WO2011/058857

PCT Pub. Date: May 19, 2011

(65) Prior Publication Data

US 2012/0206245 A1 Aug. 16, 2012

(30) Foreign Application Priority Data

Nov. 10, 2009 (JP) ..... 2009-256909

(51) Int. Cl.
*G08C 19/16* (2006.01)

(52) U.S. Cl.
USPC ..... 340/12.26; 340/12.22; 340/12.24; 340/4.3; 341/176; 348/734; 348/211.99; 348/14.05; 398/106

(58) Field of Classification Search
None
See application file for complete search history.

(56) References Cited

U.S. PATENT DOCUMENTS 7,224,903 B2 * 5/2007 Colmenarez et al. ..... 398/106
7,760,907 B2 * 7/2010 Haughawout et al. ..... 382/100
8,509,400 B2 * 8/2013 Liu et al. ..... 379/90.01
2004/0203387 A1 10/2004 Grannan
2007/0185597 A1 * 8/2007 Bejean et al. ..... 700/83
2007/0223048 A1 * 9/2007 Misawa et al. ..... 358/302

(Continued)

FOREIGN PATENT DOCUMENTS

JP 2005-065118 3/2005
JP 2005-268941 9/2005

(Continued)

OTHER PUBLICATIONS

Extended European Search Report dated Apr. 25, 2013 issued by the European Patent Office in European Patent Application No. 10829817.5, 6 pages.

(Continued)

*Primary Examiner* — Benjamin C Lee
*Assistant Examiner* — Rajsheed Black-Childress
(74) *Attorney, Agent, or Firm* — Young & Thompson

(57) ABSTRACT

Provided is a remote operation system capable of coordinating the operations of a plurality of devices without harming the familiar, intuitive behavior style of remote control operation. The remote operation system is provided with: a remote operation device which captures images of each of a plurality of devices connected to a network and specifies the devices to be operated, and which transmits operation scenario information on the coordinated operations performed among the plurality of devices to be operated, the coordinated operations being determined by the combination of the types of the specified devices to be operated; and a network control unit which outputs operation commands for executing operations specified by the operation scenario information received, to the devices specified by the operation scenario information received, when the network accommodating the plurality of devices is constructed and the operation scenario information is transmitted from the remote operation device.

21 Claims, 22 Drawing Sheets

(56) References Cited

U.S. PATENT DOCUMENTS

| | | | | |
|---|---|---|---|---|
| 2007/0236327 | A1 | 10/2007 | Miyashita et al. | |
| 2007/0296604 | A1* | 12/2007 | Koyata | 340/825.22 |
| 2008/0028430 | A1* | 1/2008 | Kreiner et al. | 725/78 |
| 2009/0102696 | A1 | 4/2009 | Park et al. | |
| 2010/0134318 | A1* | 6/2010 | Haughawout et al. | 340/825.69 |

FOREIGN PATENT DOCUMENTS

| | | |
|---|---|---|
| JP | 2005-332070 | 12/2005 |
| JP | 2006-146803 | 6/2006 |
| JP | 2006-196956 | 7/2006 |
| JP | 2007-259328 | 10/2007 |
| JP | 2009-260523 | 11/2009 |
| WO | 03/056531 | 7/2003 |

OTHER PUBLICATIONS

International Search Report, PCT/JP2010/068531, Dec. 14, 2010.

* cited by examiner

Fig.13

CONTROL-OBJECT APPARATUS REGISTRATION

| APPARATUS TYPE | PORT NUMBER | ADDRESS |
|---|---|---|
| ☐ TV | xxxx0 | 192.168.12.1 |
| ☐ AUDIO | xxxx1 | 192.168.12.2 |
| ☐ DVD | xxxx2 | 192.168.12.3 |
| ☐ LIGHTING | xxxx3 | 192.168.12.4 |

△ ▽ TO SELECT, AND ● TO DETERMINE AND CAPTURE

Fig.20

| SCENARIO IDENTIFICATION NUMBER | CONTROL-OBJECT APPARATUS | | | OPERATION |
|---|---|---|---|---|
| | APPARATUS TYPE | ADDRESS | PORT | |
| No. 1 | TV | 192.168.12.1 | xxxx0 | ・TV→ AUDIO CONNECTION (SOUND)<br>・TV ON, AUDIO ON |
| | AUDIO | 192.168.12.2 | xxxx1 | |
| No. 2 | DVD | 192.168.12.3 | xxxx2 | ・DVD→ TV CONNECTION (VIDEO, SOUND)<br>・DVD ON, TV ON<br>・SWITCH TV INPUT SOURCE |
| | TV | 192.168.12.1 | xxxx0 | |
| No. 3 | DVD | 192.168.12.3 | xxxx2 | ・DVD→ TV CONNECTION (VIDEO)<br>・DVD→ AUDIO CONNECTION (SOUND)<br>・DVD ON, TV ON, AUDIO ON<br>・SWITCH TV INPUT SOURCE |
| | TV | 192.168.12.1 | xxxx0 | |
| | AUDIO | 192.168.12.2 | xxxx1 | |
| No. 4 | DVD | 192.168.12.3 | xxxx2 | ・DVD→ TV CONNECTION (VIDEO)<br>・DVD→ AUDIO CONNECTION (SOUND)<br>・DVD ON, TV ON, AUDIO ON<br>・SWITCH TV INPUT SOURCE<br>・SET BRIGHTNESS OF LIGHTING (THEATER MODE) |
| | TV | 192.168.12.1 | xxxx0 | |
| | AUDIO | 192.168.12.2 | xxxx1 | |
| | LIGHTING | 192.168.12.4 | xxxx3 | |

REMOTE CONTROL SYSTEM, REMOTE CONTROL APPARATUS AND REMOTE CONTROL METHOD

TECHNICAL FIELD

The present invention relates to a remote control system, a remote control apparatus and a remote control method, and in particular to a remote control system, a remote control apparatus and a remote control method for apparatuses connected to a network.

BACKGROUND ART

An infrared remote controller is widely used now as a remote control apparatus to control a machine or an electronic apparatus from a distance. It performs desired control remotely on a machine or an electronic apparatus, by transmitting infrared beams modulated by control data toward an infrared receiving unit of the machine or electronic apparatus. When an infrared remote controller is used, controllable range is limited to a range within less than about ±5 degrees in upper, lower, left and right directions from the direct front, which is determined by the spreading extent of infrared beams, and within a distance of about 5 to 10 meters, which is determined by the reaching distance of infrared beams.

Such an infrared remote controller is attached to every kind of apparatus because of its operation convenience. For example, it is provided to customers by being attached to a television, DVD (Digital Versatile Disk) recorder/player, audio system, air conditioner, lighting apparatus, camera, game machine, personal computer and the like. Further, as an apparatus provided for the purpose of integrating infrared remote controllers attached to so many apparatuses into a single controller, there are apparatuses called a learning remote controller and a multi remote controller.

In recent years, not only communication-related apparatuses but also many other kinds of apparatuses such as AV (Audio Visual) and control apparatuses have come to be connected to a network. For example, with a home network being built in a home, and AV apparatuses such as a television, a DVD recorder/player, and an audio system, or control apparatuses such as an air conditioner, a lighting apparatus and a security system being connected to the home network, these apparatuses can be controlled from outside the home.

Patent document 1 discloses a technology of a remote control apparatus which remotely controls an apparatus via a network by capturing images of apparatuses connected to the network, and, when controlling an apparatus, displaying the captured image on a display unit and selecting the desired apparatus. Further, the remote control apparatus can remotely control a plurality of different kinds of apparatuses by itself alone.

When capturing an image of an apparatus to be an object of remote control, the remote control apparatus disclosed in patent document 1 acquires apparatus-specific information in the form of infrared signals from the apparatus itself, and stores it in a memory relating it to the captured image. During remote control, when a user selects a desired apparatus from images displayed on the display unit, a user interface, an operation control program and apparatus-specific information corresponding to the selected image are retrieved. Then, a user interface for controlling the apparatus to be an object of the remote control is displayed on the display unit, and the remote control apparatus makes a connection to the apparatus connected to the network, using a wireless communication means and on the basis of the apparatus-specific information.

Subsequently, the user can remotely control the apparatus connected to the network by performing operations based on the user interface displayed on the display unit of the remote control apparatus.

Patent document 2 discloses a technology of a control system for remote control which a user wears on his/her head and which is equipped with an image-capturing device for capturing an image of an area within his/her sight. This control system also can remotely control a plurality of different kinds of apparatuses by itself alone.

The control system disclosed in patent document 2 recognizes a control-object apparatus on the basis of image information obtained by the image-capturing device, triggered by the control-object apparatus's entering the user's sight, and of identification information stored in a storage device, and sends an operation command inputted by the user to the control-object apparatus. Accordingly, this control system can automatically identify a control-object apparatus entering the user's sight and then remotely control the control-object apparatus. Further, the user inputs an operating command by pointing on a virtual controller displayed on a semi-transparent type optical element which is provided in the control system he/she wears.

Patent document 3 discloses a technology of a remote control apparatus which makes possible remote control of a plurality of objective apparatuses without adding any function to the control-object apparatuses.

The remote control apparatus disclosed in patent document 3 captures an image of a control-object apparatus, extracts a letter string from the captured image, and thereby identifies the control-object apparatus from among a plurality of objective apparatuses. Then, the remote control apparatus sets each button of an operation unit according to the specified control-object apparatus, and displays an operation method of the operation unit on a liquid crystal display unit. Here, the remote control apparatus uses conventional infrared beams in the remote control of the identified apparatus. Accordingly, in the technology disclosed in patent document 3, an artifice such as of providing a remote control apparatus for relaying is made in order to expand the controllable range.

CITATION LIST

Patent Literature

[Patent Document 1] Japanese Patent Application Laid-Open No. 2007-259328

[Patent Document 2] Japanese Patent Application Laid-Open No. 2006-146803

[Patent Document 3] Japanese Patent Application Laid-Open No. 2005-268941

SUMMARY OF INVENTION

Technical Problem

Remote control operation by an infrared remote controller is very intuitive operation of pressing an operation button with the remote controller pointed at an apparatus to control. However, as described above, when an infrared remote controller is used, controllable range is limited to a range within less than about ±5 degrees in upper, lower, left and right directions from the direct front, which is determined by the spreading extent of infrared beams, and within a distance range of about 5 to 10 meters, which is determined by the reaching distance of infrared beams. Further, although there are apparatuses capable of integrating a plurality of infrared remote controls into a single one, such as a learning remote controller and a multi remote controller, it is difficult for them to perform control of a plurality of apparatuses in a linked manner. For example, they cannot perform linked control between apparatuses such as of, for the purpose of watching a movie recorded in a DVD, turning on a television and a DVD player and causing the DVD player to play the DVD.

The remote control apparatus disclosed in patent document 1 can perform remote control without depending on the distance from a control-object apparatus. However, even when a control-object apparatus exists in a short distance, the remote control apparatus requires operations of extracting images stored in a memory and selecting a specific image while watching the images displayed on a liquid crystal screen of the remote control apparatus. Therefore, with this remote control apparatus, it is impossible to perform an intuitive operation of operating the remote control apparatus while pointing it at an apparatus to control, which have been familiar to users for many years.

Even when a non-directional remote controller comes to be used, it is considered to be desired not to break the familiar behavior style of remote control operation of operating a remote controller while pointing it at an apparatus to control.

The control system disclosed in patent document 2 has a characteristic in that it identifies a control-object apparatus by a captured image. However, the user is required to perform a peculiar operation such as of inputting an operation command by pointing on a virtual controller displayed on a semi-transparent optical element. Further, accordingly, the system configuration is complicated.

Although the remote control apparatus disclosed in patent document 3 has a characteristic in that it extracts a letter string from a captured image when identifying a control-object apparatus, it performs conventional remote control using infrared beams. Accordingly, even though a disclosure of a remote control apparatus for relaying is also given there, the configuration becomes complicated and the controllable range is limited.

The technologies disclosed in patent documents 1 to 3 each can provide a remote control apparatus capable of remotely controlling a plurality of different kinds of apparatuses by itself alone. However, it is difficult for the technologies disclosed in patent documents 1 to 3 to provide a remote control apparatus capable of performing remote control of a plurality of different kinds of apparatuses in a linked manner.

The objective of the present invention is to provide a remote control system, a remote control apparatus and a remote control method which solve the above-described problem.

Solution to Problem

In order to achieve the objective described above, a remote control system in the present invention comprises: a remote control apparatus which captures respective images of a plurality of apparatuses connected to a network, thereby identifies control-object apparatuses, and transmits control scenario information concerning cooperative operation among a plurality of control-object apparatuses, which is determined by a combination of types of the identified control-object apparatuses; and a network control unit which constitutes the network containing the aforementioned plurality of apparatuses, and, when receiving the control scenario information from the remote control apparatus, outputs, to apparatuses prescribed by the received control scenario information, control orders to cause the apparatuses to perform operations prescribed by the received control scenario information.

Further, a remote control apparatus of the present invention is a remote control apparatus remotely controlling a plurality of apparatuses contained in a network control unit, and is characterized by that it comprises: a control-object apparatus identification means for capturing respective images of a plurality of aforementioned apparatuses and thereby identifying apparatuses to control; and a control scenario output means for outputting control scenario information which prescribes operations of each of the control-object apparatuses in cooperative operation among a plurality of control-object apparatuses, which is determined by a combination of types of the identified control-object apparatuses, and also in that the network control unit receives the control scenario information and causes the control-object apparatuses to execute operations prescribed by the control scenario information.

Further, a remote control method of the present invention is characterized by that it comprises: a control-object apparatus identification step wherein a remote control apparatus captures respective image of a plurality of apparatuses connected to a network control unit, and thereby identifies control-object apparatuses; a control scenario transmission step wherein the remote control apparatus transmits control scenario information concerning cooperative operation between a plurality of control-object apparatuses, which is determined by a combination of types of the identified control-object apparatuses; and a control order output step wherein the network control unit outputs, to apparatuses prescribed by the received control scenario information, control orders to cause the apparatuses to perform operations prescribed by the received control scenario information.

Advantageous Effects of Invention

According to the present invention, it is possible to perform remote control of a plurality of different kinds of apparatuses in a linked manner, without breaking an intuitive behavior style of remote control operation which has been familiar to users.

BRIEF DESCRIPTION OF THE DRAWINGS

FIG. 13 is a diagram showing an example of a screen at the time of the operation of control-object apparatus registration displayed on the display unit of the remote control apparatus according to the exemplary embodiment 2 of the present invention.

FIG. 20 is a diagram showing an example of control scenario information in the linked control mode of the exemplary embodiment 2 of the present invention.

DESCRIPTION OF EMBODIMENTS

Exemplary embodiments of the present invention will be described with reference to drawings.

Figure 1:
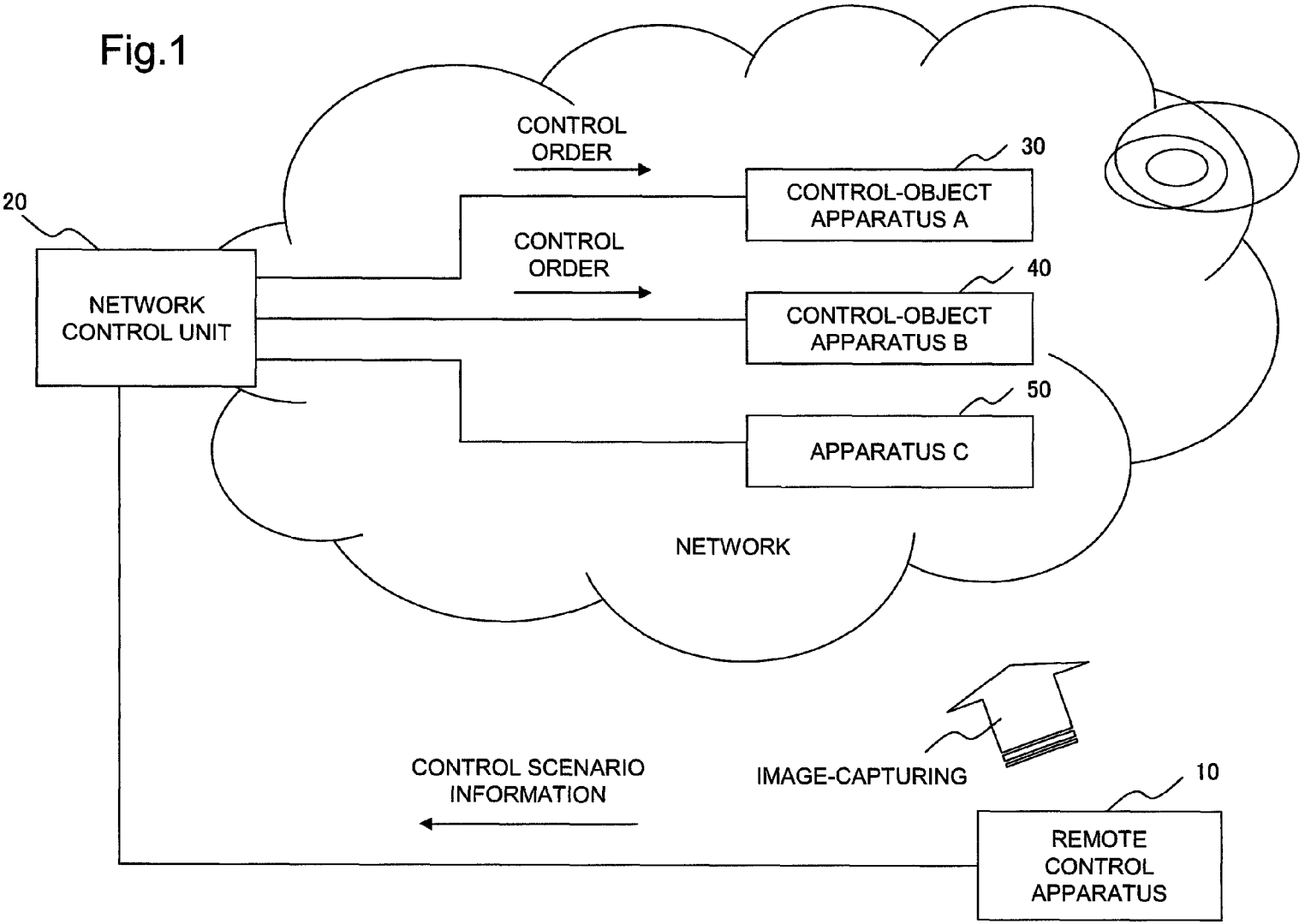
FIG. 1 is a block configuration diagram showing a system configuration according to a basic exemplary embodiment of the present invention.

FIG. 1 is a block configuration diagram showing a system configuration according to a basic exemplary embodiment of the present invention.

A remote control apparatus 10 is a device for remotely controlling apparatuses connected to a network. In FIG. 1, apparatuses to be controlled by the remote control apparatus 10 are shown, for example, as a control-object apparatus A, 30, and a control-object apparatus B, 40. While an apparatus C, 50, is also an apparatus connected to the network, it is supposed not to be a control-object apparatus at present.

A network control unit 20 constitutes the network by containing the control-object apparatus A, 30, control-object apparatus B, 40, and apparatus C, 50.

The remote control apparatus 10 captures respective images of a plurality of optional apparatuses connected to the network, and thereby identifies apparatuses to be controlled. The remote control apparatus 10 transmits control scenario information concerning cooperative operation between a plurality of control-object apparatuses which is determined by a combination of types of the identified control-object apparatuses.

When receiving the control scenario information from the remote control apparatus 10, the network control unit 20 outputs, to apparatuses prescribed by the received control scenario information, control orders to cause the apparatuses to perform operations prescribed by the received control scenario information.

FIG. 1 schematically illustrates the situation described above, such as where the control apparatus 10 captures respective images of the apparatuses and where it transmits control scenario information. Further, FIG. 1 illustrates also a situation where the network control unit 20 makes orders to apparatuses prescribed by the received control scenario information (control-object apparatus A, 30, and control-object apparatus B, 40) to execute operations prescribed by the control scenario information.

Figure 2:
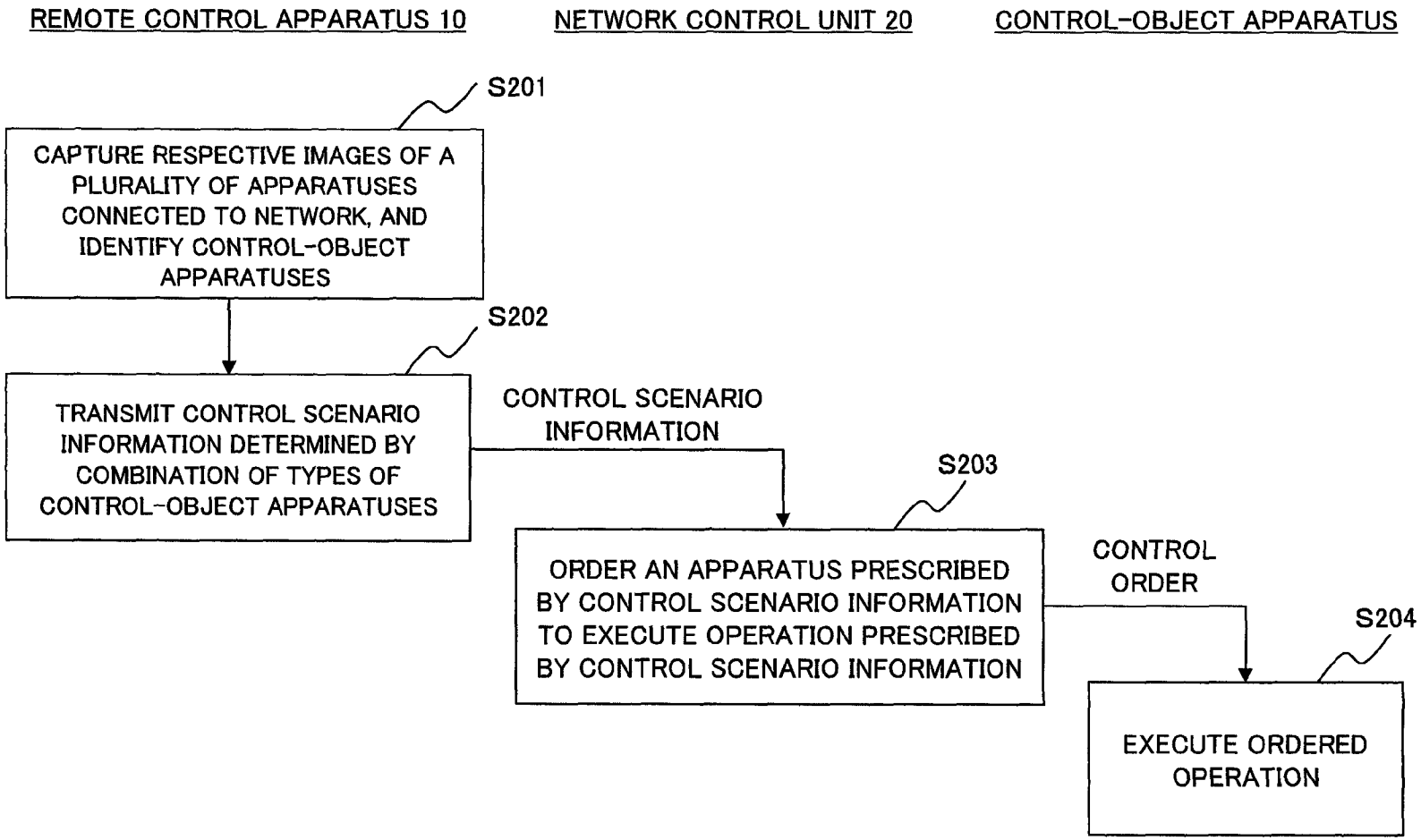
FIG. 2 is a sequence diagram showing operation according to the basic exemplary embodiment of the present invention.

FIG. 2 is a sequence diagram showing operation according to the basic exemplary embodiment of the present invention.

The remote control apparatus 10 captures respective images of a plurality of optional apparatuses connected to the network, and thereby identifies control-object apparatuses (S201). The remote control apparatus 10 transmits control scenario information determined by a combination of types of the control-object apparatuses (S202). The control scenario information is sent to the network control unit 20. The network control unit 20 outputs control orders to execute operations prescribed by the control scenario information to apparatuses prescribed by the control scenario information (S203). The control orders are each sent to respective control-object apparatuses. Each of control-object apparatuses having received the control orders executes operations specified by the respective control orders (S204).

Figure 3:
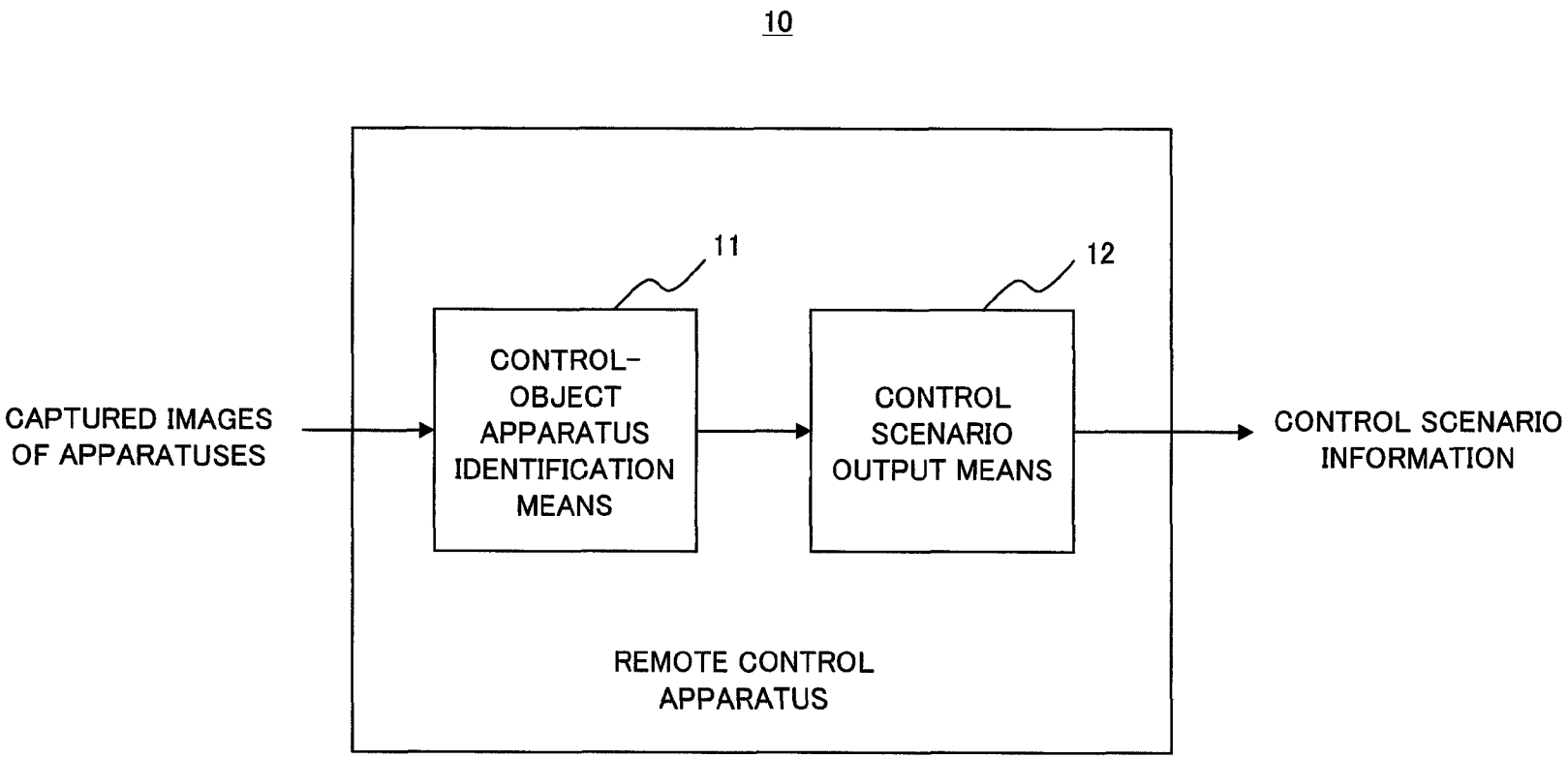
FIG. 3 is a block configuration diagram showing a configuration of a remote control apparatus according to the basic exemplary embodiment of the present invention.

FIG. 3 is a block configuration diagram showing a configuration of the remote control apparatus according to the basic exemplary embodiment of the present invention.

The remote control apparatus 10 is a remote control apparatus to remotely control a plurality of apparatuses contained by the network control unit. The remote control apparatus 10 comprises a control-object apparatus identification means 11 which captures respective images of a plurality of apparatuses and thereby identifies apparatuses to control. The remote control apparatus 10 further comprises a control scenario output means 12 which outputs control scenario information prescribing operations of each apparatus in cooperative operation between a plurality of control-object apparatuses, which is determined by a combination of types of the identified control-object apparatuses. Then, the aforementioned network control unit receives the control scenario information, and causes the control-object apparatuses to execute operations prescribed by the control scenario information.

As has been described above, in the basic exemplary embodiment of the present invention, the user points the remote control apparatus 10 at apparatuses desired to be control objects of cooperative operation, and captures images of the apparatuses. This operation manner is an intuitive behavior style of remote controller operation which has been familiar to users. A combination of types of control-object apparatuses identified by the operation determines control scenario information concerning cooperative operation among a plurality of control-object apparatuses. As the control scenario information prescribes apparatuses to be controlled and their operations, each control-object apparatus can execute cooperative control operations on the basis of the control scenario information.

Next, referring to FIGS. 4 and 5, description will be given of configurations and operation of a remote control apparatus and a network control unit according to an exemplary embodiment 1 of the present invention.

Figure 4:
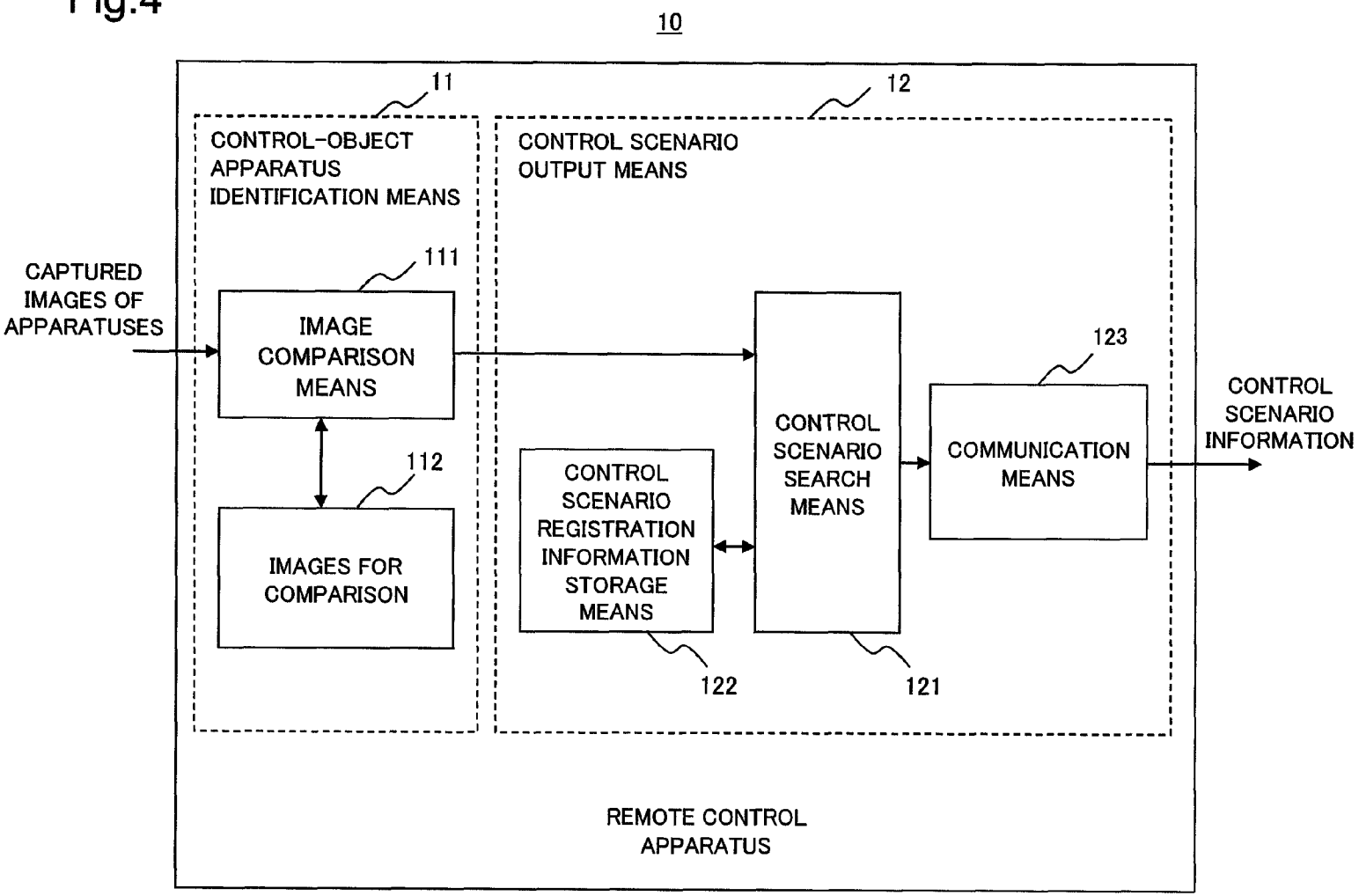
FIG. 4 is a block configuration diagram showing a configuration of a remote control apparatus according to an exemplary embodiment 1 of the present invention.

FIG. 4 is a block configuration diagram showing a configuration of the remote control apparatus according to the exemplary embodiment 1 of the present invention. As described with respect to the basic exemplary embodiment, the user captures images of apparatuses desired to be control objects of cooperative operation by pointing a remote control apparatus 10 at the apparatuses. For example, it is supposed that the user captures respective images of a television and a DVD player.

The images of the apparatuses obtained by this operation are transmitted to a control-object apparatus identification means 11. The control-object apparatus identification means 11 identifies control-object apparatuses by comparing the inputted images of the apparatuses with images for comparison 112 stored in advance, using an image comparison means 111. The information on the identified control-object apparatuses is transmitted to a control scenario output means 12.

The control scenario output means 12 searches, on the basis of a combination of types of the identified control apparatuses and using a control scenario search means 121, to find which control scenario of control scenario registration information stored in advance in a control scenario registration information storage means 122 corresponds to the combination.

While a control scenario will be described later, it is assumed here that performing the following control operations is prescribed as a control scenario for the case where respective images of a television and a DVD player are captured, for example.

connect video and audio outputs of a DVD player to a line input of a television.

turn on the television and the DVD player.

switch an input source of the television to the line input.

That is, this is an example of a control scenario which orders to connect a DVD player to a television, turn on the television and the DVD player and prepare for watching video images played by the DVD player on the television.

At that time, the information retrieved from the control scenario registration information storage means 122 includes a control scenario such as that described above corresponding to the combination of a television and a DVD player, or control scenario identification information enabling to identify a scenario having the above-described contents.

The control scenario output means 12 outputs the control scenario information obtained by the search via a communication means 123.

As described above, the control scenario information outputted from the remote control apparatus 10 includes either a control scenario itself prescribing specific operations of each apparatus or control scenario identification information enabling to identify a control scenario having such contents. In this case, an indicator flag for indicating which type of control scenario information is outputted may be attached.

Figure 5:
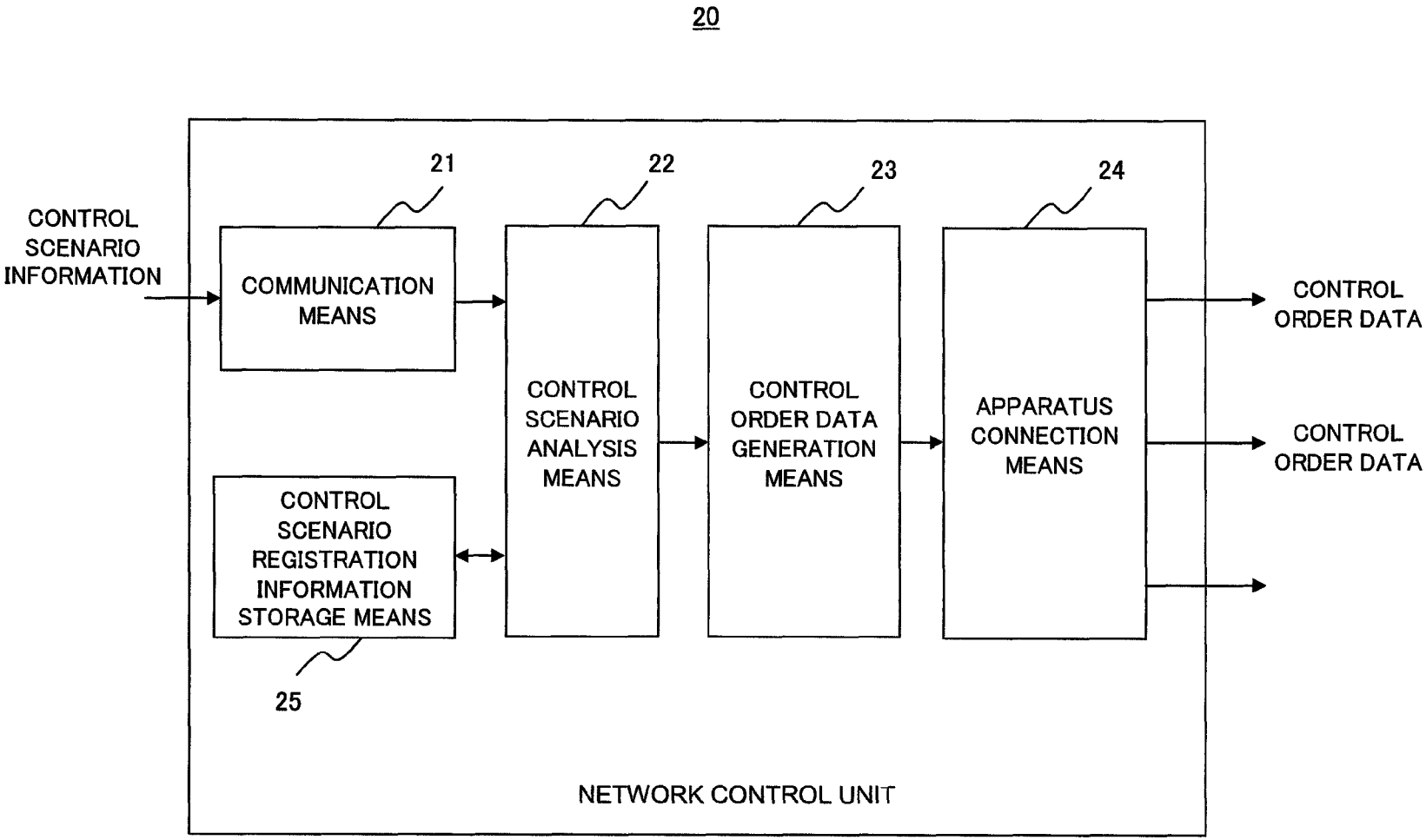
FIG. 5 is a block configuration diagram showing a configuration of a network control unit according to the exemplary embodiment 1 of the present invention.

FIG. 5 is a block configuration diagram showing a configuration of the network control unit according to the exemplary embodiment 1 of the present invention.

The control scenario information outputted by the remote control apparatus 10 is received by a communication means 21 of the network control unit 20, and is transmitted to a control scenario analysis means 22.

When the control scenario information outputted by the remote control apparatus 10 is control scenario identification information, the control scenario analysis means 22 searches a control scenario registration information storage means 25 by the control scenario identification information. By the search, the control scenario analysis means 22 acquires information on specific operation contents with respect to each apparatus which are prescribed by a corresponding control scenario.

On the other hand, when the control scenario information outputted by the remote control apparatus 10 is a control scenario itself prescribing specific operations of each apparatus, the above-described searching operation is not necessary.

When the control scenario information is outputted with an indicator flag, the control scenario analysis means 22 can identify, by the indicator flag, the one to perform between the two kinds of operations described above. Further, even when an indicator flag is not attached, the control scenario analysis means 22 can identify which of the two kinds of control scenario information is received, by observing the data amount of the received control scenario information.

On acquiring control-object apparatuses and contents of specific operations prescribed by the control scenario, the control scenario analysis means 22 analyzes them. By the analysis, the control scenario analysis means 22 identifies each control-object apparatus and prepares for generating control order data for each control-object apparatus. Specifically, it outputs control order data including control-object apparatus information specifying each control-object apparatus and the type of a control order generated for each control-object apparatus. Additionally, information on connections between the control-object apparatuses may be included.

The control scenario analysis means 22 transmits the analysis result data to a control order data generation means 23 and directs it to generate control order data.

On receiving the direction to generate control order data for each control-object apparatus from the control scenario analysis means 22, the control order data generation means 23 generates control order data corresponding to each control-object apparatus on the basis of the transmitted analysis result data. Then, the control order data generation means 23 transmits the generated control order data to an apparatus connection means 24.

The apparatus connection means 24 is equipped with ports to connect respective apparatuses, and can identify which of the ports each control-object apparatus is connected to.

With respect to a control operation for which setting of connections between apparatuses is possible within the network control unit, the connection control is ordered to the connection means 24. For example, when control of "connect video and audio outputs of a DVD player to a line input of a television" can be executed by the apparatus connection means 24, the connection control is ordered to the apparatus connection means 24.

Further, with respect to an operation to be executed by individual control-object apparatus, the apparatus connection means 24 sends control order data to a corresponding control-object apparatus. For example, it sends control order data of "power on" and "switch input source to line input" to a television, and that of "power on" to a DVD player.

In the present exemplary embodiment, resulting from the configurations and operations described above, by only the user's performing remote control operation with the remote control apparatus 10 pointed at apparatuses desired to be control-object apparatuses of cooperative operation, each of the control-object apparatuses can execute the cooperative operation. That is, by only the user's capturing images of a television and a DVD player, the image comparison means 111 compares inputted images of the apparatuses with images for comparison 112 stored in advance, and thereby identifies control-object apparatuses as the television and the DVD player. Informed that control-object apparatuses are the television and the DVD player, the control scenario search means 121 searches the control scenario registration information storage means 122 to find which one of control scenarios stored in advance in the registration information storage means 122 corresponds to the combination of control-object apparatuses. Then, the retrieved control scenario is sent to the network control unit 20, where specific contents of the control scenario are analyzed by the control scenario analysis means 22. As a result of the analysis, pieces of control order data prescribing operations of respective apparatuses are generated by the control order data generation means 23, and the pieces of control order data are sent to respective apparatuses. Consequently, the DVD player is connected to the television, and the television and the DVD player are turned on, and thereby preparation for watching video images played by the DVD player on the television is accomplished.

A more detailed exemplary embodiment will be described based on an exemplary embodiment 2.

Figure 6:
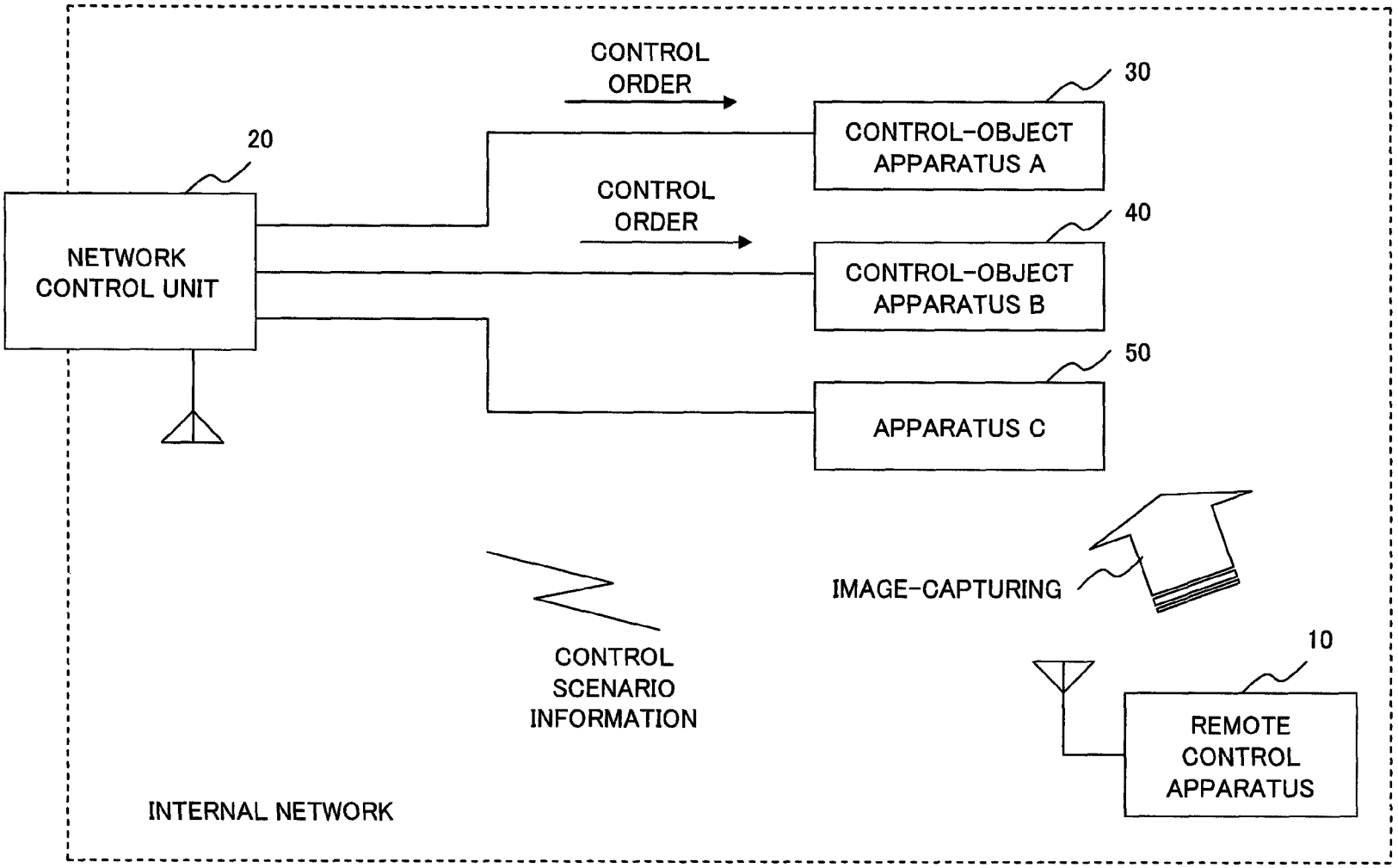
FIG. 6 is a block configuration diagram showing a system configuration according to an exemplary embodiment 2 of the present invention.

FIG. 6 is a block diagram showing a system configuration according to the exemplary embodiment 2 of the present invention.

The exemplary embodiment 2 is an example of applying the present invention to an internal network established by wireless LAN (Local Area Network), power line communication network or the like.

A network control unit 20 is equipped with a control apparatus establishing such an internal network, and communicates with a remote control apparatus 10 by wireless. As a wireless communication method in this case, wireless LAN, Bluetooth (registered trademark) or low power wireless communication may be applied. Accordingly, even when the distance between the remote control apparatus 10 and the network control unit 20 is from at least 10 to 100 meters, communication is possible between the two. Therefore, the use of the present exemplary embodiment is not limited to that in a home, but is possible also in a meeting room, a small hall, an event site or the like.

Other portions of the system configuration are the same as that of the basic exemplary embodiment described above with reference to FIG. 1. The network control unit 20 can contain a plurality of apparatuses. In FIG. 6, three contained apparatuses are illustrated as examples. The network control unit 20 is supposed to contain a control-object apparatus A, 30, and a control-object apparatus B, 40, which are intended to be objects of remote control by the user, and an apparatus C, 50, which is not intended to be an object of remote control at present.

Figure 7:
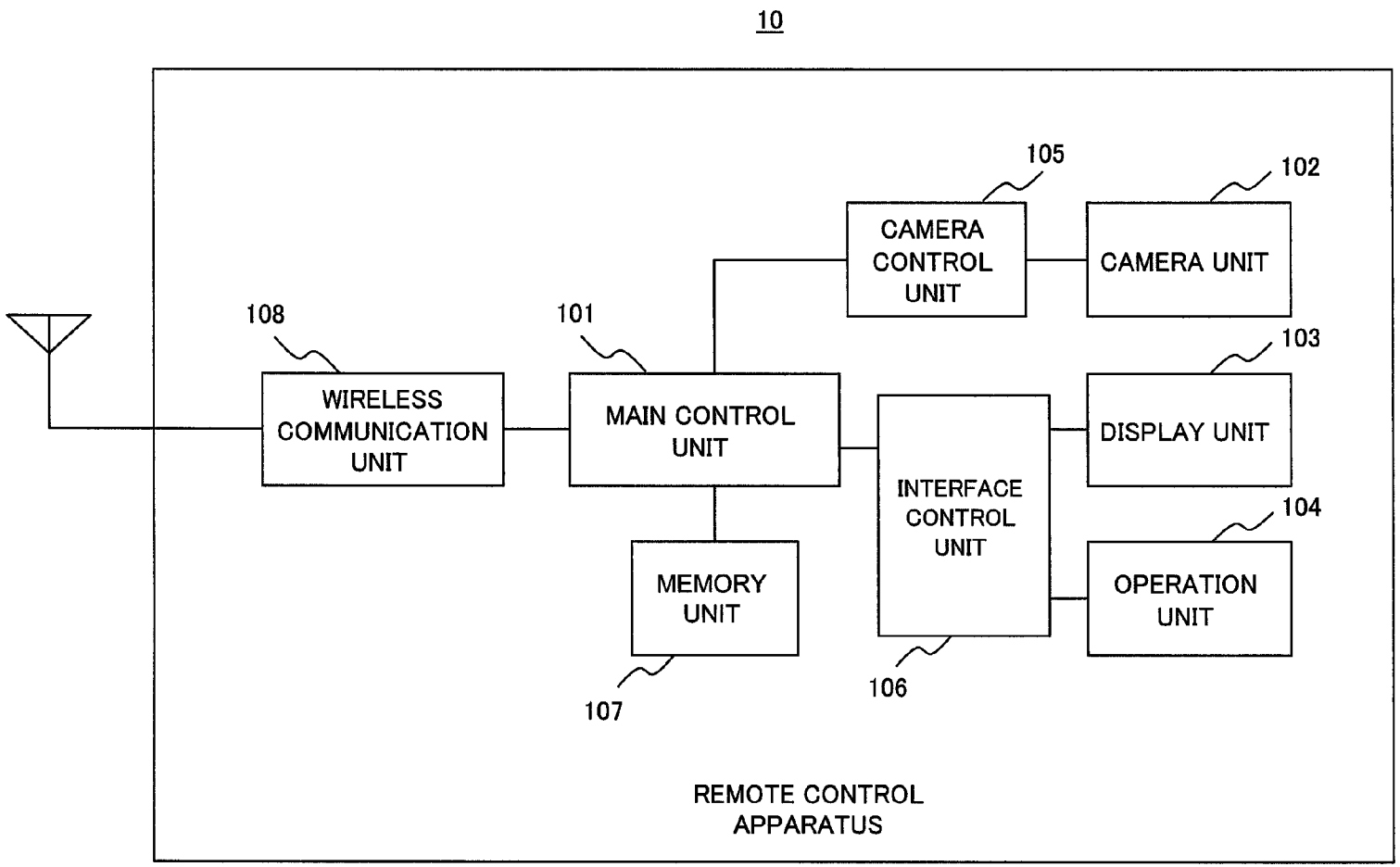
FIG. 7 is a block configuration diagram showing a configuration of a remote control apparatus according to the exemplary embodiment 2 of the present invention.

FIG. 7 is a block configuration diagram showing a configuration of the remote control apparatus 10 according to the exemplary embodiment 2 of the present invention.

Figure 9:
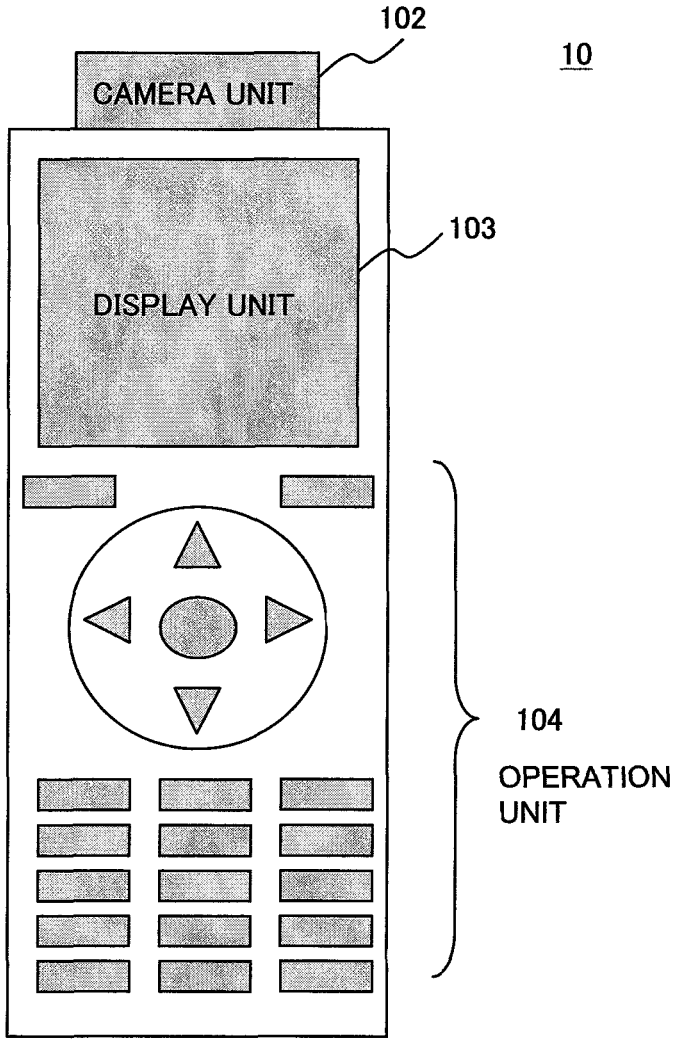
FIG. 9 is an exterior view showing an upper surface appearance of the remote control apparatus according to the exemplary embodiment 2 of the present invention.

As its exterior is shown in FIG. 9, the remote control apparatus 10 is equipped, at the outside surface of its body, with a camera unit 102 for capturing an image of an apparatus to be a control object, an operation unit 104 for performing input operations of remote control and a display unit 103 for presenting operation methods of the operation unit 104 and the like.

Within the body, included are a main control unit 101, a camera control unit 105, an interface control unit 106, a memory unit 107 and a wireless communication unit 108, as primary components.

The main control unit 101 is in charge of control relevant to overall operation of the remote control apparatus 10 by the use of a main program stored in the memory unit 107. Besides the main program, various application programs are stored in the memory unit 107. The application programs stored in the memory unit 107 execute control operations of the remote control apparatus 10 in cooperation with the main control unit 101 and other control units such as the camera control unit 105 and the interface control unit 106. Here, the image comparison means and the control scenario search means described with respect to the exemplary embodiment 1 are achieved by control operations executed by the main control unit 101.

Besides those programs, the memory unit 107 is provided with areas for storing image information for comparison and control scenario registration information described above with respect to the exemplary embodiment 1. In addition, a control interface program for each control-object apparatus, which will be described later, is stored in the memory unit 107.

The camera control unit 105 executes control relevant to an image-capturing operation using the camera unit 102. The interface control unit 106 performs control such as of displaying on the display unit 103 and of identifying information inputted by operations on the operation unit 104.

The wireless communication unit 108 performs wireless communication between the remote control apparatus 10 and the network control unit 20.

Figure 8:
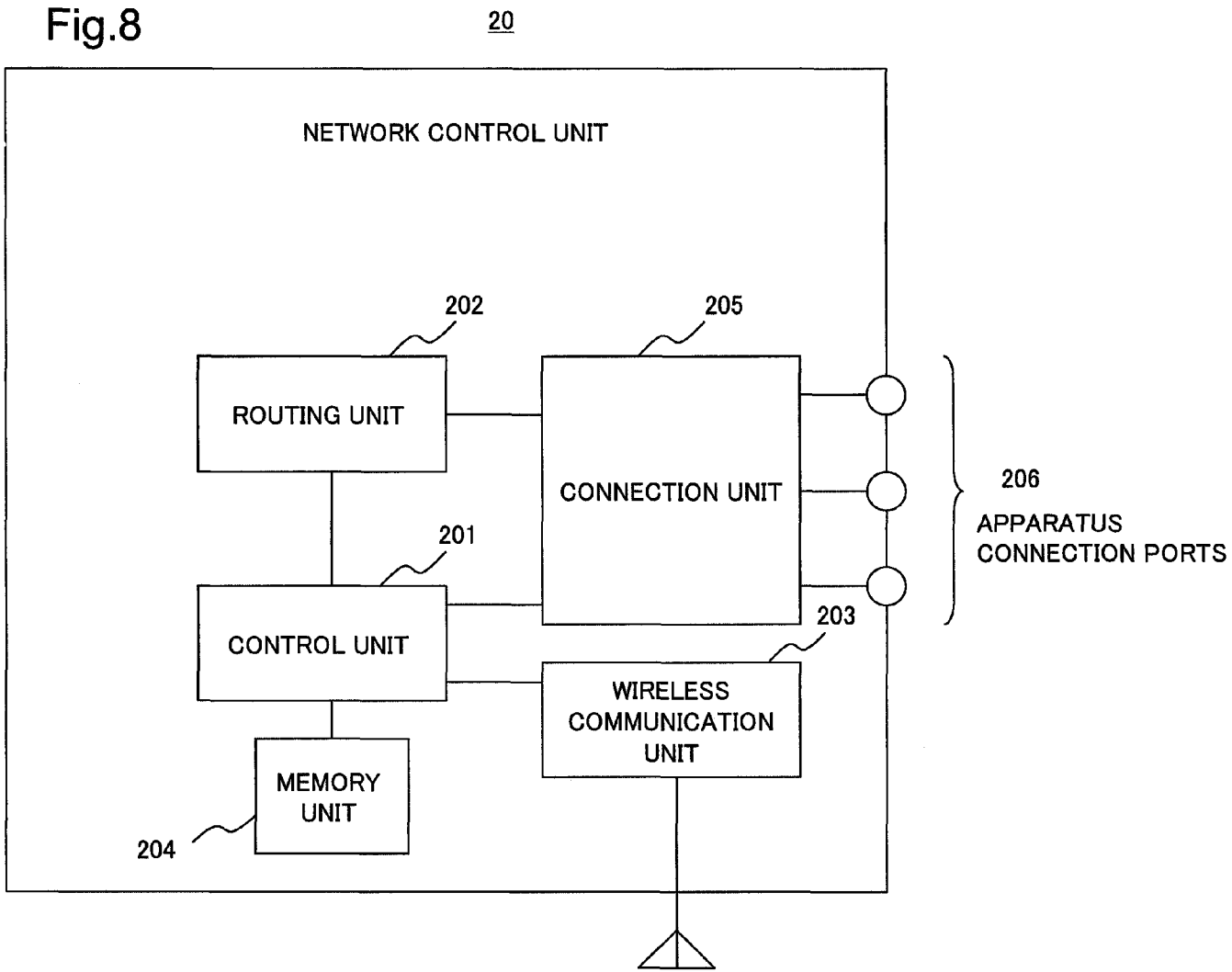
FIG. 8 is a block configuration diagram showing a configuration of a network control unit according to the exemplary embodiment 2 of the present invention.

FIG. 8 is a block configuration diagram showing an example of a configuration of the network control unit 20 according to the exemplary embodiment 2 of the present invention.

In FIG. 8, a control unit 201 is in charge of control relevant to overall operation of the network control unit 20 by the use of a program stored in a memory unit 204. Here, the control scenario analysis means and the control order data generation means described with respect to the exemplary embodiment 1 are achieved by control operations executed by the control unit 201.

The memory unit 204 is provided with areas for storing, besides the program, the control scenario registration information described above with respect to the exemplary embodiment 1 and various kinds of data relevant to the contained apparatuses.

A connection unit 205 is equipped with apparatus connection ports 206 for connecting the contained apparatuses, and executes control for which setting of connections between the apparatuses is possible within the network control unit.

A routing unit 202 performs routing of control order data, which is outputted from the control unit 201 and to be transmitted to control-object apparatuses, to objective ports of the connection unit 205.

A wireless communication unit 203 performs wireless communication between the network control unit 20 and the remote control apparatus 10.

Next, operation of the present exemplary embodiment will be described.

Figure 10:
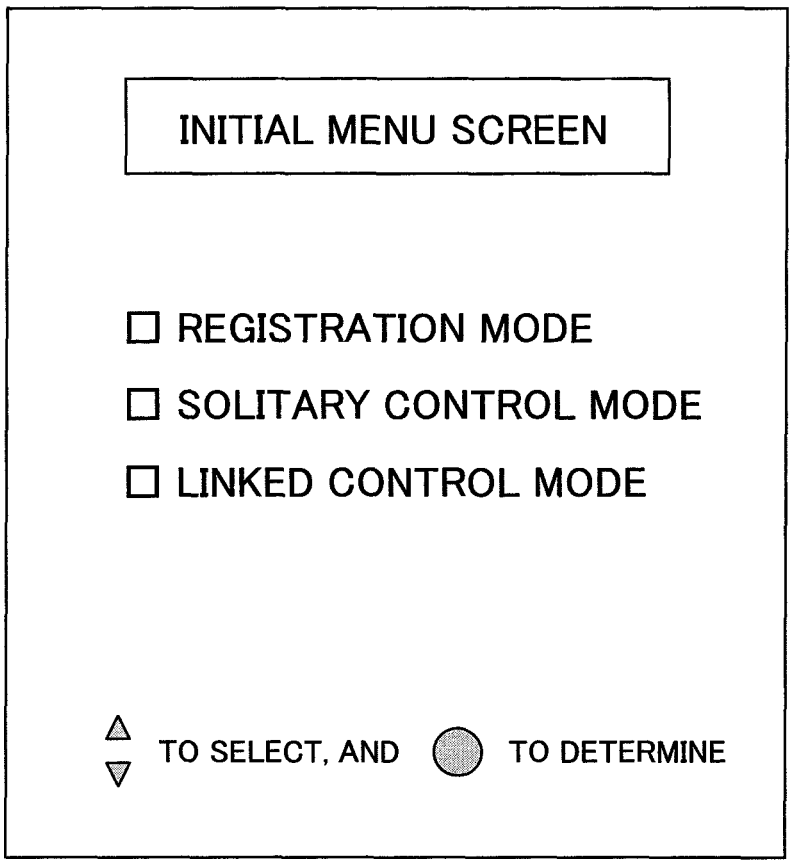
FIG. 10 is a diagram showing an example of an initial menu screen displayed on a display unit of the remote control apparatus according to the exemplary embodiment 2 of the present invention.

FIG. 10 is a diagram showing an example of an initial menu screen displayed on the display unit 103 of the remote control apparatus 10 according to the exemplary embodiment 2 of the present invention.

As shown in the initial menu screen, the remote control apparatus 10 has three operation modes.

A registration mode is an operation mode for registering apparatuses intended to be objects of remote control in advance. A solitary control mode is an operation mode for remotely controlling apparatuses individually. Further, a linked control mode is an operation mode for remotely controlling a plurality of apparatuses in a cooperative manner. By the user's selecting any one of the modes and performing a determination operation with a button for execution, operation of each of the modes is executed.

Figure 11:
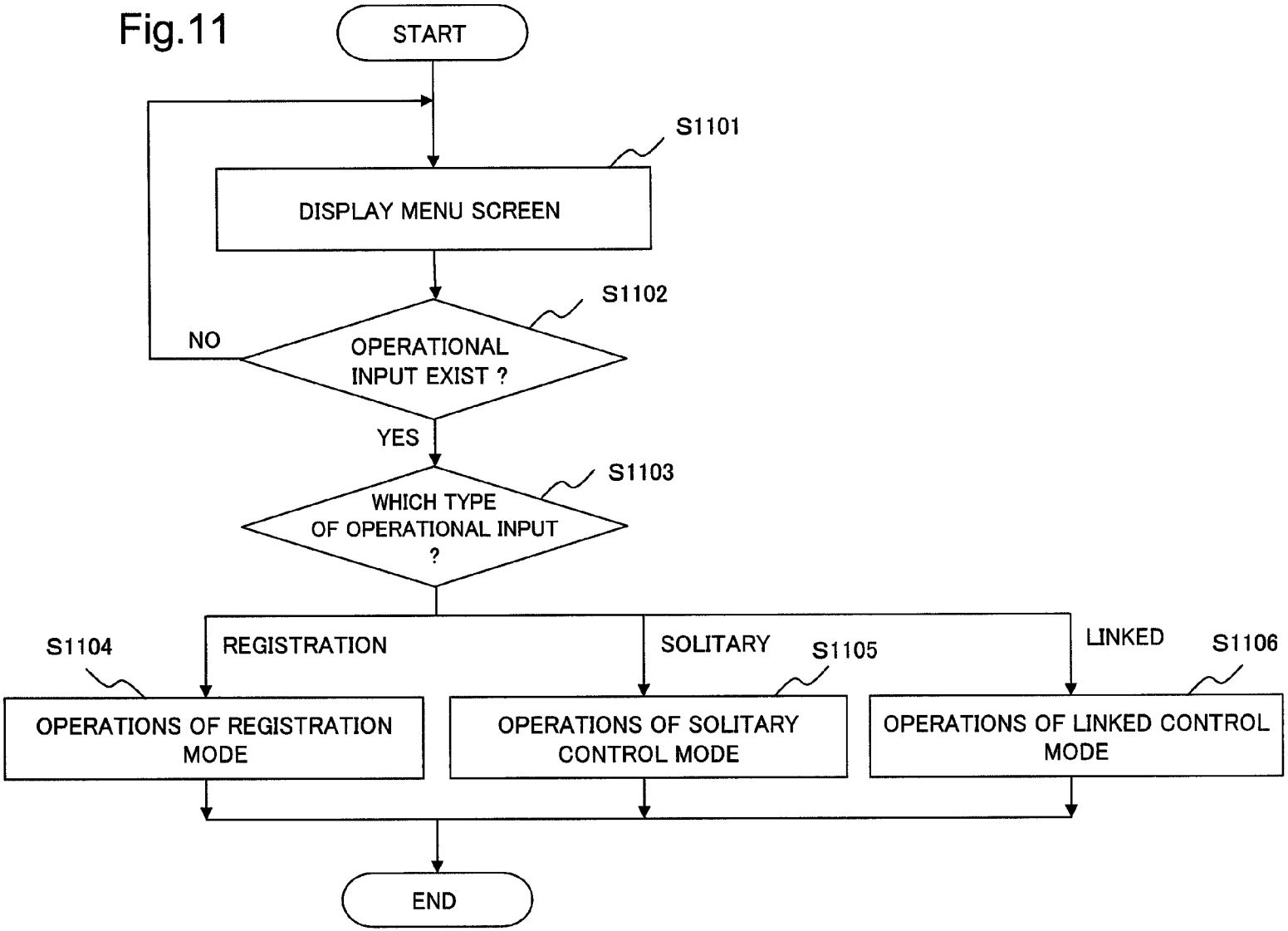
FIG. 11 is a flow diagram showing operation of an initial menu of the remote control apparatus according to the exemplary embodiment 2 of the present invention.

FIG. 11 is a flow diagram showing initial menu operation of the remote control apparatus 10.

In an initial state just after the power is switched on, the initial menu screen shown in FIG. 10 appears on the display unit 103 of the remote control apparatus 10, and the remote control apparatus 10 enters a state of waiting for an input of control by the user (S1101, NO at S1102)

When the user selects any one of the modes and performs a determination operation with a button for execution (YES at S1102), which one of the menus is selected is identified (S1103).

When the registration mode is selected, operation of the registration mode is executed (S1104). When the solitary control mode is selected, operation of the solitary control mode is executed (S1105). Further, when the linked control mode is selected, operation of the linked control mode is executed (S1106).

In the following, operation will be described for each of the modes one by one.

Figure 12:
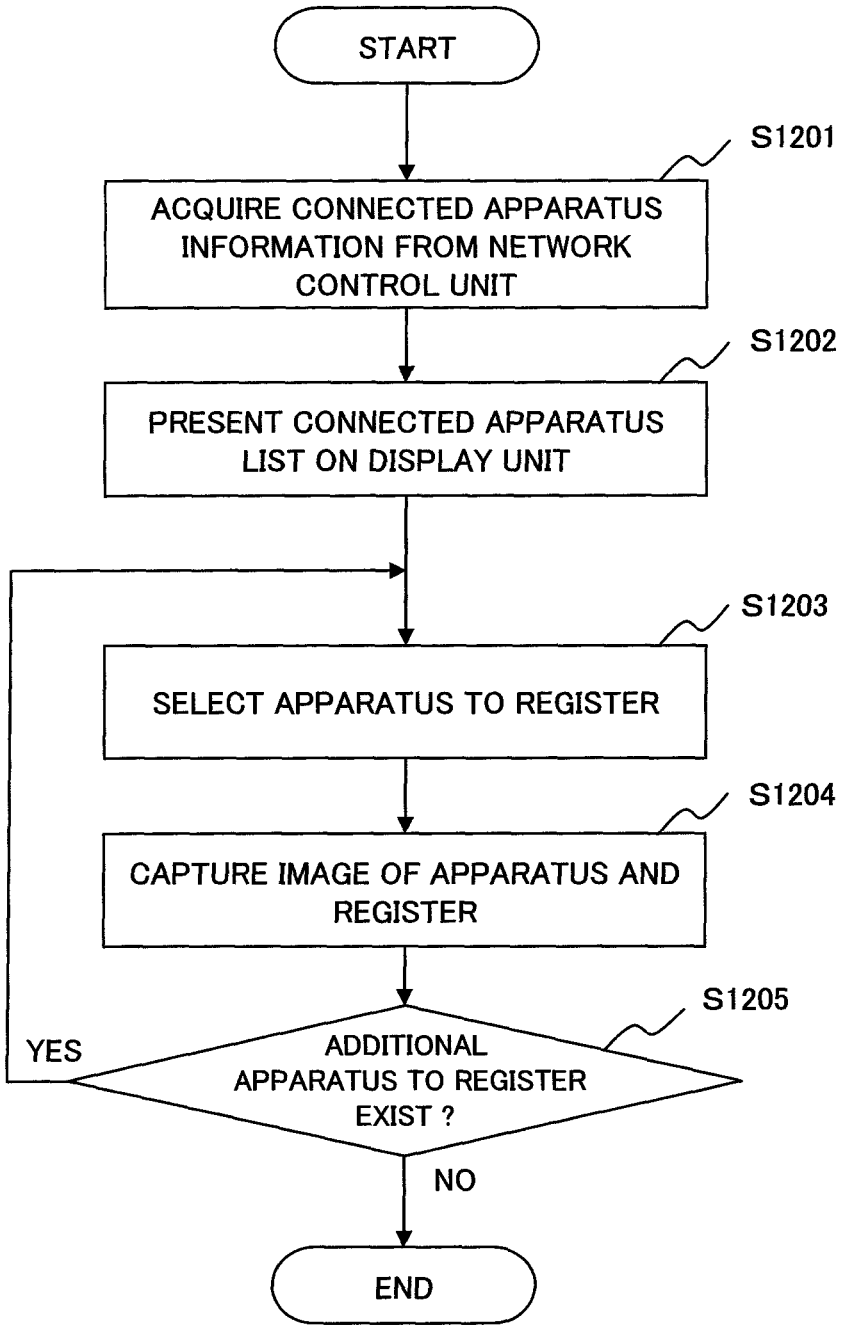
FIG. 12 is a flow diagram showing operation of control-object apparatus registration of the remote control apparatus according to the exemplary embodiment 2 of the present invention.

FIG. 12 is a flow diagram showing operation of control-object apparatus registration in the remote control apparatus 10.

First, description will be given of information on contained apparatuses, which is managed by the network control unit 20.

When apparatuses are connected to respective apparatus connection ports 206 of the network control unit 20, the control unit 201 of the network control unit 20 recognizes the apparatuses by communication with a control unit of each apparatus, which is not illustrated in the drawings. Then, type information and connection position information on the connected apparatuses are identified. Further, an address for the use in the internal network is given to each apparatus by, for example, a DHCP (Dynamic Host Configuration Protocol) function. Then, in the memory unit 204 of the network control unit 20, those pieces of information on each apparatus connected to the network control unit 20 are stored as connected device information.

When the remote control apparatus 10 starts operation of the registration mode in this state, the remote control apparatus 10 communicates with the network control unit 20 and thereby acquires the connected device information from the network control unit 20 (S1201).

The connected device information acquired from the network control unit 20 is displayed on the display unit 103 of the remote control apparatus 10, as shown in FIG. 13 (S1202). FIG. 13 shows a situation where apparatus types, port numbers and addresses of apparatuses connected to the network control unit 20 are displayed.

The user selects an apparatus desired to be registered as a control-object apparatus and performs a determination operation (S1203). This user operation is transmitted from the operation unit 104 of the remote control apparatus 10 to the main control unit 101 via the interface control unit 106. Receiving the transmission of the user operation, the main control unit 101 orders the camera control unit 105 to start up the camera unit 102.

Using the activated camera unit 102, the user captures an image of an exterior view of the control-object apparatus, and performs a registration operation (S1204). In this image capturing of an exterior of the apparatus, the user may capture images of a plurality of exterior views from different angles. By doing such a way, in the cases of the solitary control mode and the linked control mode described later, a comparison operation, which is an operation to identify apparatuses to be control objects, is performed more accurately.

With respect to an apparatus whose registration operation is completed, a sign indicating completion of registration is given on the display unit 103, and its image is stored in the memory unit 107 of the remote control apparatus 10 as an image for comparison, being related to relevant apparatus information including an apparatus type, a port number, an address and the like.

When the user continues the registration operation (YES at S1205), operations from the step S1203 described above are repeated again.

When the user completed the registration operation (NO at S1205), the registration mode operation is ended.

Next, description will be given of operation of when the user selects the solitary control mode on the initial menu screen, in a situation where the above-described registration mode operation has been completed.

Figure 14:
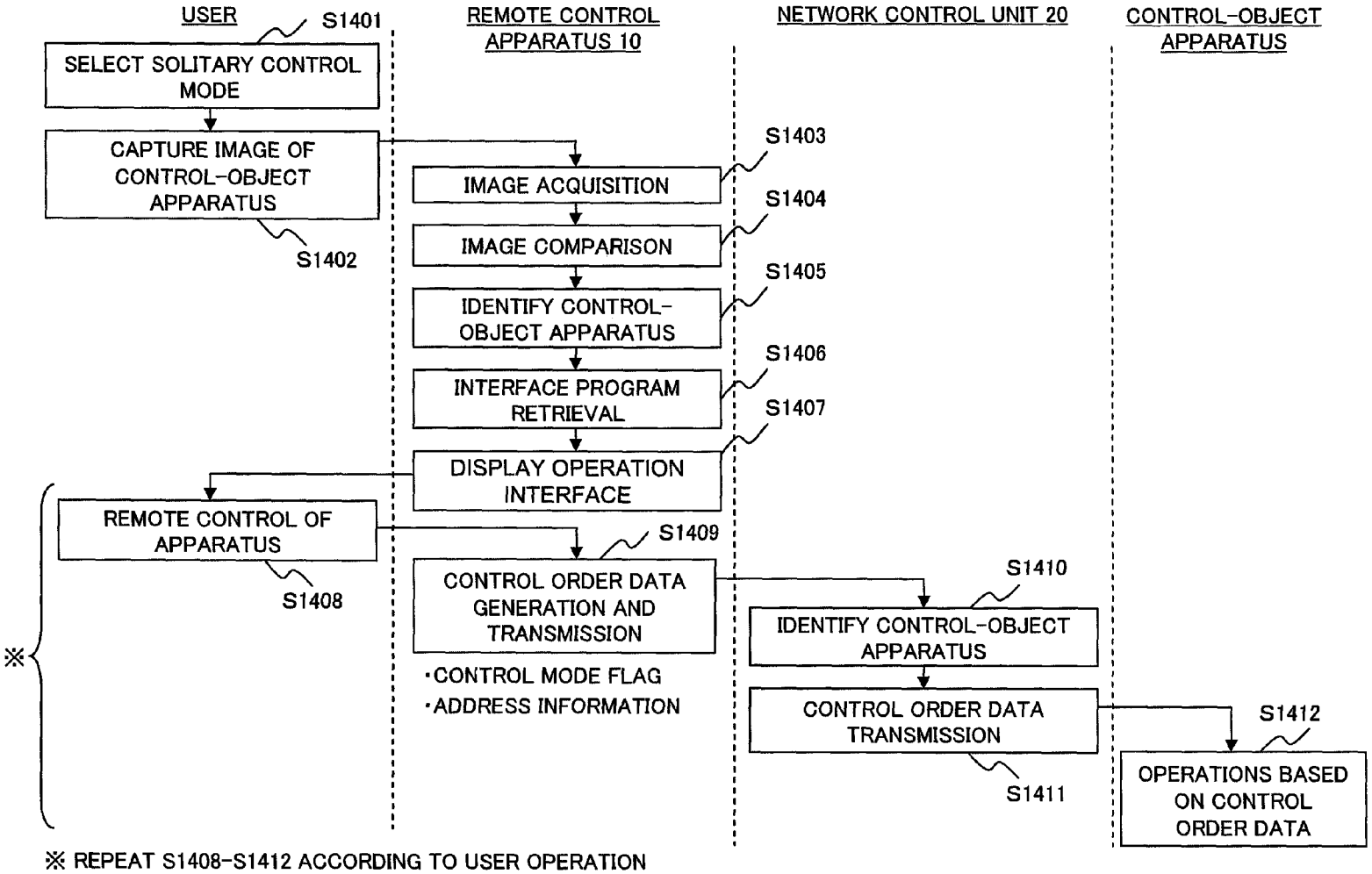
FIG. 14 is a sequence diagram showing operation according to a solitary control mode of the exemplary embodiment 2 of the present invention.

FIG. 14 is a sequence diagram showing operation relevant to the solitary control mode.

As a first step, the user selects the solitary control mode on the initial menu screen on the display unit 103 of the remote control apparatus 10 and performs a determination operation (S1401). This user operation is transmitted from the operation unit 104 to the main control unit 101 via the interface control unit 106, of the remote control apparatus 10. Receiving the transmission of the user operation, the main control unit 101 orders the camera control unit 105 to start up the camera unit 102.

The user performs an image capturing operation with the activated camera unit 102 pointed at a control-object apparatus (S1402). That is, if the display unit 103 has been switched to show a monitor screen, the user may release the shutter after confirming the control-object apparatus is displayed on the monitor screen.

The image captured by the user is sent from the camera control unit 105 to the main control unit 101 (S1403), and is compared with images for comparison registered in the registration mode (S1404). By this comparison operation, retrieved is apparatus information stored in relation to an image for comparison which matches the presently captured image, and thereby the control-object apparatus is identified (S1405).

When the control-object apparatus is identified, the main control unit 101 retrieves an interface program corresponding to the apparatus from the memory unit 107, and transmits it to the interface control unit 106. The interface control unit 106 defines keys of the operation unit 104 as that in an operation-key arrangement according to the transferred interface program, and displays their descriptions on the display unit 103 (S1407).

Figure 15:
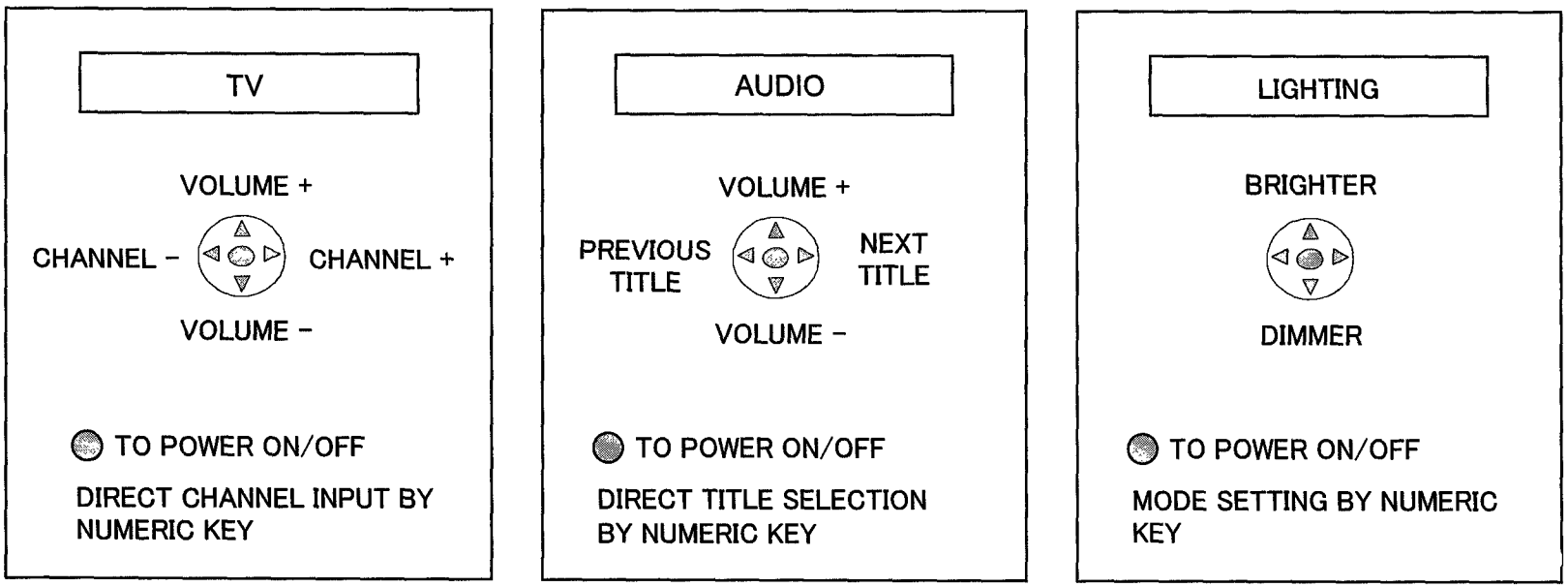
FIG. 15 is a diagram showing examples of screens in the solitary control mode displayed on the display unit of the remote control apparatus according to the exemplary embodiment 2 of the present invention.

FIG. 15 is a diagram showing examples of operation-key description screens in the solitary control mode displayed on the display unit 103 of the remote control apparatus 10.

FIG. 15(*a*) is presented when the control-object apparatus is identified as a television. Shown is an example where a four-way directional key is used for volume control and channel switching, numeric keys for direct input of channel numbers, and a determination key for power-on and off. FIG. 15(*b*) is presented when the control-object apparatus is identified as an audio apparatus. Shown is an example where the four-way directional key is used for volume control and changing a title to play, the numeric keys for directly specifying a title to play, and the determination key for power-on and off. Further, FIG. 15(*c*) is presented when the control-object apparatus is identified as a lighting apparatus. Shown is an example where the four-way directional key is used for brightness control, and the determination key for power-on and off. It would not be necessary to mention that these figures are shown just as examples, and the settings are not limited to them.

The user performs desired remote control by operating the keys of the operation unit 104 of the remote control apparatus 10 (S1408).

This user operation is transmitted from the operation unit 104 of the remote control apparatus 10 to the main control unit 101 via the interface control unit 106. The main control unit 101 identifies control content of the user operation, and generates control order data according to the content, and transmits it to the network control unit 20 via the wireless communication unit 108 (S1409). Here, the control order data transmitted to the network control unit 20 includes address information specifying the control-object apparatus. Further, in order to discriminate from the linked control mode, which will be described later, a control mode flag indicating the solitary control mode is attached.

The control order data is received by the wireless communication unit 206 of the network control unit 20, and is transmitted to the control unit 201.

From the control data flag attached to the control order data, the control unit 201 of the network control unit 20 identifies that the solitary control mode is in operation. Further, the control unit 201 identifies the control-object apparatus from the address information included in the control order data (S1410).

Then, the control unit 201 transmits the control order data to the control-object apparatus via the routing unit 202 and via the connection unit 205 (S1411).

The control-object apparatus executes operations specified by the received control order data (S1412).

The operations of the above-described steps from S1408 to S1412 are repeated each time the user operates the keys of operation unit 104 of the remote control apparatus 10.

As has been described above, in the solitary control mode of the present exemplary embodiment, an apparatus whose image is captured by the user pointing the camera unit 102 of the remote control apparatus 10 at the apparatus is identified as an object apparatus of the remote control, and control according to a type of the apparatus can be performed. Further, if the camera unit 102 is provided with a zoom function, because an object apparatus can be captured in an image from a distance, the uses in a large meeting room, a small hall, an event site and the like are possible.

Further, the following configuration may be employed in consideration of the use at a place such as where apparatuses to control are densely installed.

As an example, a configuration of the remote control apparatus 10 may be such that, from among images displayed on the display unit 103 when the user points the camera unit 102 at a control-object apparatus, a square frame, for example, is superposed on an image which the camera unit 102 recognizes as a capturing target. As another example, the remote control apparatus 10 may be configured to send a control signal indicating an identified control-object apparatus to the network control unit 20 when the apparatus is identified by an acquired image in the step S1405 in FIG. 5. In this case, on the basis of the control signal received from the remote control apparatus 10, the network control unit 20 transmits control order data to order to light up a display means installed in the object apparatus. An LED (Light Emitting Diode) will be mentioned as an example of the display means.

Next, description will be given of operation of when the user selects the linked control mode on the initial menu screen, in a situation where the registration mode operation has been completed.

As described with respect to the exemplary embodiment 1, the linked control mode is an operation mode capable of causing a plurality of control-object apparatuses to perform operations in a linked manner. Operations of the linked control mode include operation for registering a control scenario and linked control mode execution operation for remotely controlling a plurality of apparatuses in a linked manner under a situation where a control scenario has been registered.

Figure 16:
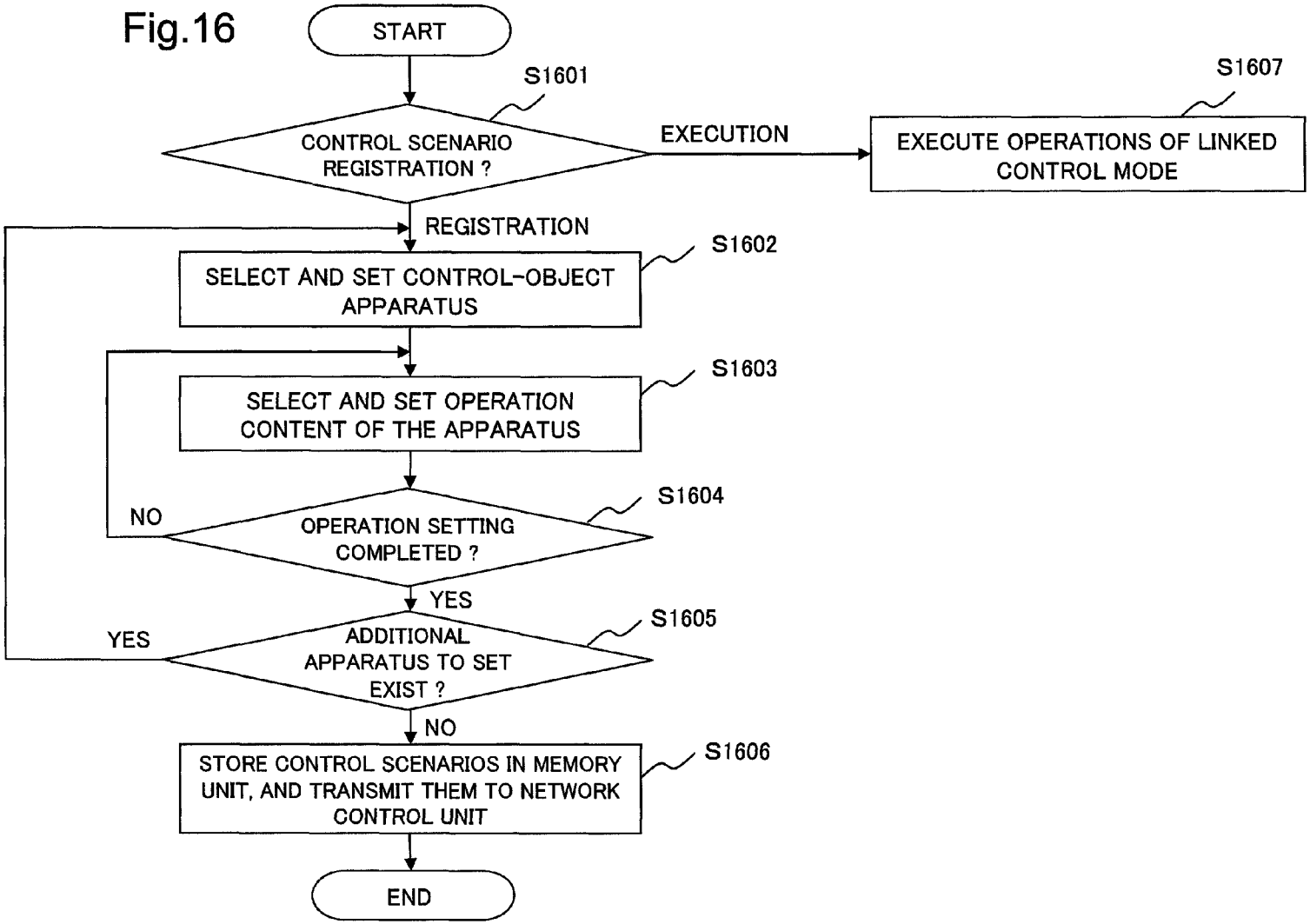
FIG. 16 is a sequence diagram showing operation according to control scenario registration in a linked control mode of the exemplary embodiment 2 of the present invention.

FIG. 16 is a sequence diagram showing operation relevant to control scenario registration in the linked control mode of the exemplary embodiment 2 according to the present invention.

Figure 17:
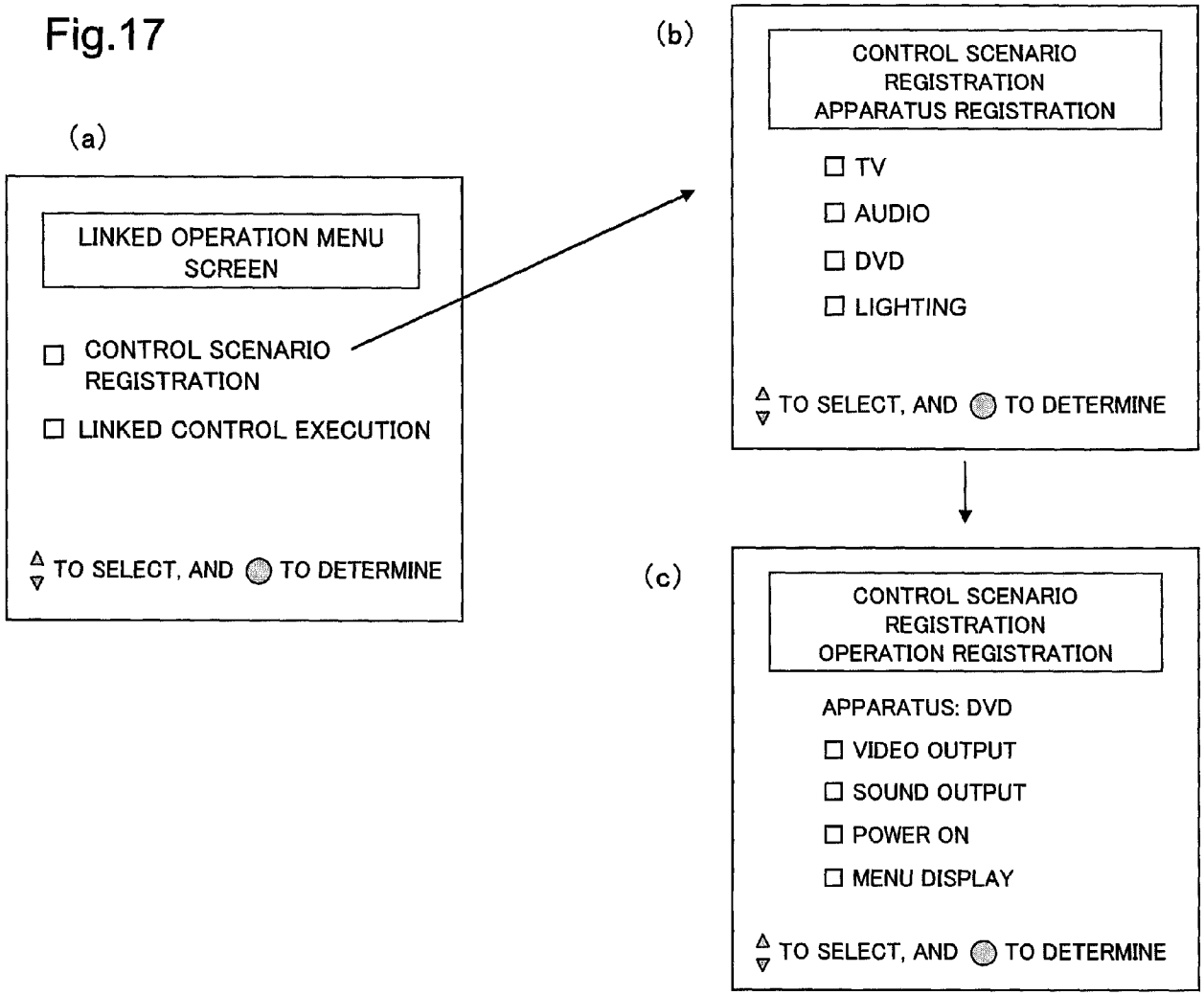
FIG. 17 is a diagram showing examples of screens, displayed on the display unit, according to the control scenario registration in the linked control mode of the exemplary embodiment 2 of the present invention.

When the user selects the linked control mode on the initial menu screen of the remote control apparatus 10 and performs a determination operation, a screen on the display unit 103 switches to a menu screen of the linked control mode shown in FIG. 17(*a*). On this menu screen of the linked control mode, selection between a control scenario registration operation and a linked control mode execution operation is possible.

When the user selects the control scenario registration operation on the menu screen of the linked control mode (registration at S1601), a screen for selecting control-object apparatuses shown in FIG. 17(*b*) appears on the display unit 103. At that time, on the display unit 103, also presented is a list of apparatuses registered as control-object apparatuses by the registration operation described with reference to FIG. 12.

For example, it is supposed that the user registers a linked control scenario of "output video images and sound played by a DVD player from a television".

The user selects "DVD player" from the screen of registered apparatuses list and performs its setting (S1602).

Then, on the display unit 103, as shown in FIG. 17(*c*), presented is an operation registration screen, according to the selected apparatus type, for selecting among operation contents possible to be set. There, the user selects an operation of "video output" and performs its setting (S1603). When there is a further operation to be set (NO at S1604), returning to the operation registration screen, the user sets and registers the operation desired to be performed next. In the present case, the user selects and sets "sound output", and then does "power on".

When setting operation of "DVD player" is completed (YES at S1604), the user returns to the screen for selecting a control-object apparatus in order to select "TV" which is an apparatus to be controlled in a linked manner (YES at S1605). Selecting "TV" on the screen for selecting a control-object apparatus, the user moves to the operation registration screen and selects and sets desired operations there in the same way as described above. In the present case, the user selects and sets "video input", "sound input", "power on" and "switch input source to line input".

When the user has completed the registration operation of a control scenario (NO at S1605), the registered control scenario is stored in the memory unit 107 of the remote control apparatus 10, and the same control scenario is transmitted to the network control unit 20 (S1606).

Control scenarios are created by the above-described operations, and are held by both the remote control apparatus 10 and the network control unit 20.

FIG. 20 is a diagram showing examples of control scenarios of the linked control mode of the exemplary embodiment 2 according to the present invention. Given a scenario identification number, each control scenario is stored in each of the memory unit 107 of the remote control apparatus 10 and the memory unit 204 of the network control unit 20.

Here, control scenarios shown in FIG. 20 prescribe the following cooperative operations respectively. A scenario identification number No. 1 prescribes "output sound of TV from audio apparatus". A scenario identification number No. 2 prescribes "output video and sound played by DVD player from TV". A scenario identification number No. 3 prescribes "output video and sound played by DVD player from TV and audio apparatus, respectively". A scenario identification number No. 4 prescribes "output video and sound played by DVD player from TV and audio apparatus, respectively, and set brightness of lighting apparatus at theater mode".

Here, the registration method of a control scenario described above is just an example, and the method is not limited to it. The method may be configured such that scenarios of different control contents can be registered according to a selection order of control-object apparatuses. For example, registered may be a control scenario where a selection of "TV" prescribes operation of "video recording" and a subsequent selection of "DVD" prescribes operations for TV program recording. In this case, when the user intends to have a control scenario of "output video and sound played by DVD player from TV" executed, remote control operations to be performed by the user are selecting "DVD" and subsequently selecting "TV". To have a control scenario of "record TV program on DVD recorder" executed, the user selects "TV" and subsequently selects "DVD".

Next, description will be given of operation of when the user selects the linked control mode execution operation on the menu screen of the linked control mode, in a situation where control scenarios have been registered in the way described above. In this case, at a corresponding selection branch in FIG. 16 (execution at S1601), operation is transferred to the linked control mode operation execution (S1607).

Figure 18:
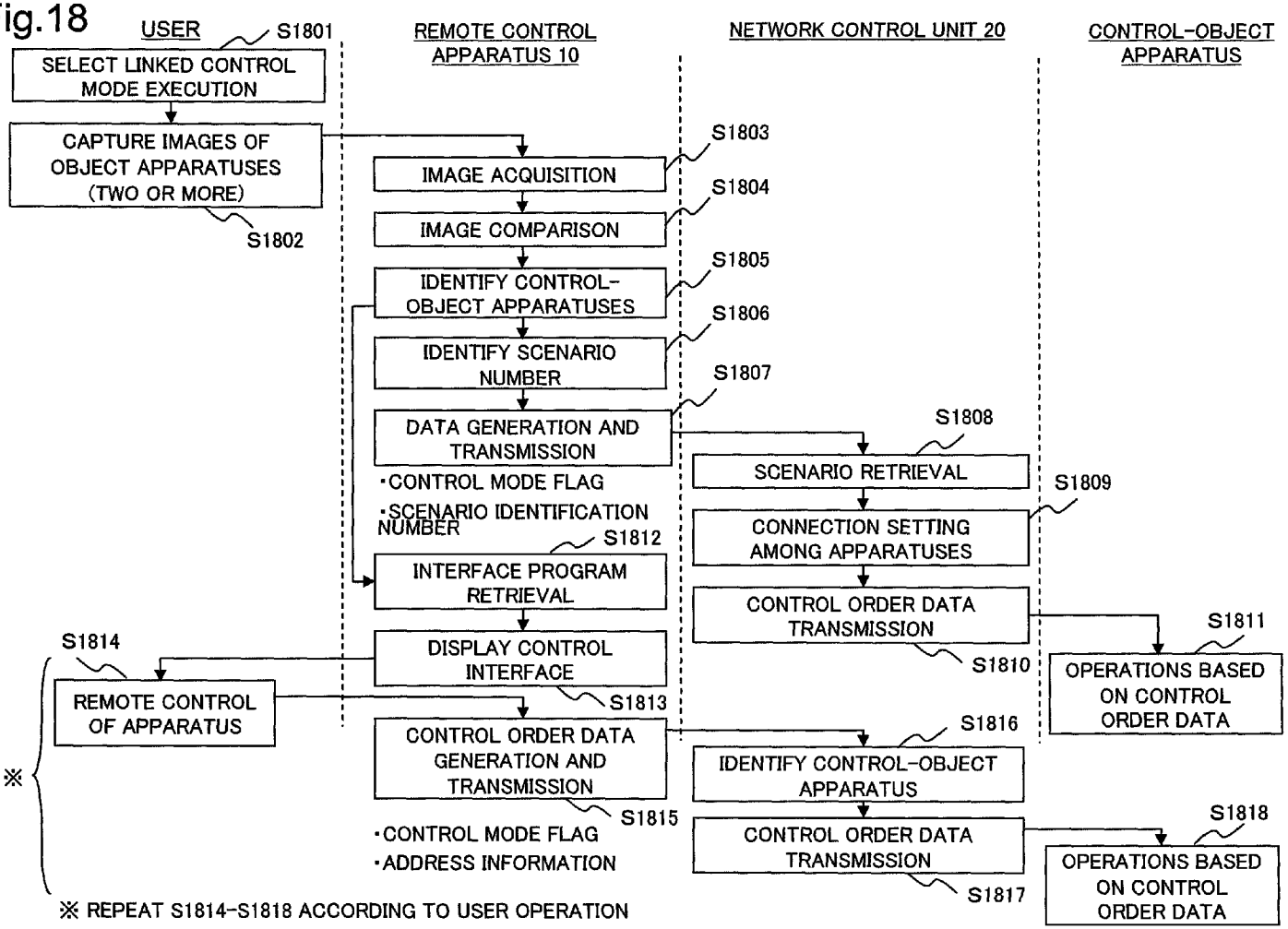
FIG. 18 is a sequence diagram showing operation according to remote control in the linked control mode of the exemplary embodiment 2 of the present invention.

FIG. 18 is a sequence diagram showing operation according to remote control of the linked control mode.

When the linked control mode execution is selected (S1801), this user operation is transmitted from the operation unit 104 of the remote control apparatus 10 to the main control unit 101 via the interface control unit 106. Receiving the transmission of the user operation, the main control unit 101 orders the camera control unit 105 to start up the camera unit 102.

The user performs an operation of capturing an image of a control-object apparatus with the camera unit 102 pointed at the apparatus, on each of a plurality of control-object apparatuses (S1802). That is, to perform a linked control of "output video and sound played by DVD player from TV", the user needs only to capture an image of "DVD player" and subsequently of "TV".

The images captured by the user are sent one by one from the camera control unit 105 to the main control unit 101 (S1803), and are compared with images for comparison registered in the registration mode (S1804). By this comparison operation, retrieved are pieces of apparatus information each stored in relation to respective images for comparison matching the captured images, and thereby the control-object apparatuses are identified (S1805). In this case, "DVD player" and "TV" are identified.

Further, at that time, because the linked control mode execution is selected, the main control unit 101 searches for a control scenario determined by the combination of the identified control-object apparatuses from among registered control scenarios stored in the memory unit 107 (S1806). For example, from the control scenarios list shown in FIG. 20, the scenario identification number No. 2 is retrieved.

Then, the main control unit 101 transmits control scenario information to the network control unit 20 so as to cause it to execute operations based on the control scenario. As already described with respect to the exemplary embodiment 1, the control scenario information transmitted from the remote control apparatus 10 to the network control unit 20 may be content itself of the control scenario and also may be identification information for enabling identification of the content of the control scenario. In the present case, it is assumed that a scenario identification number is transmitted, in order to reduce transmitted information amount.

The main control unit 101 generates control order data including a control mode flag indicating the linked control mode and the scenario identification number (No. 2), and transmits it to the network control unit 20 via the wireless communication unit 108 (S1807).

The control order data received by the wireless communication unit 203 of the network control unit 20 is transmitted to the control unit 201. By the use of the control mode flag indicating the linked control mode and the scenario identification number (No. 2) included in the control order data, the control unit 201 searches the control scenarios stored in the memory unit 204 and retrieves a corresponding control scenario (S1808).

That is, "DVD player" and "TV" are identified as control-object apparatuses, along with their respective addresses and port numbers. Then, as operations to be executed, identified are "output video and sound of DVD player to TV", "power on of DVD player", "power on of TV" and "switch input source of TV".

The control unit 201 executes operations, from among the identified operations, which are possible in the network control unit 20 such as connection settings between the apparatuses. (S1809). For example, when the operation of "output video and sound of DVD player to TV" can be executed by controlling the connection unit 205, the control unit 201 orders the connection unit 205 to execute a corresponding connection.

Then, the control unit 201 generates pieces of control order data to be transmitted to the respective control-object apparatuses and transmits them, via the routing unit 202 and the connection unit 205, from the ports to which the respective apparatuses are connected (S1810). Each of the pieces of control order data includes commands indicating operations to execute, and address and port information for routing. Through these pieces of control order data, information on the operations to execute is transmitted to the objective apparatuses.

In the present case, control order data including a command of "power on" is transmitted to "DVD player". To "TV", transmitted are control order data including a command of "power on" and that including a command of "switch input source".

Each apparatus executes operations according to the commands included in the received control order data (S1811).

On the other hand, on completing transmission of the control scenario information, the remote control apparatus 10 sets the operation unit 104 into a state where the user can input the next control of the linked control.

The main control unit 101 retrieves interface programs corresponding to the control-object apparatuses identified at S1805 from the memory unit 107 (S1812) and transmits them to the interface control unit 106. In the present case, interface programs of "DVD player" and "TV" are retrieved.

The interface control unit 106 defines the keys of the operation unit 104 as that in an operation key arrangement according to the transmitted interface programs, and presents their descriptions on the display unit 103 (S1813). While, in the linked control mode, interface programs relevant to a plurality of apparatuses are retrieved, only one of the interfaces is displayed on the display unit 103, but a user operation can switch an interface to be displayed.

Figure 19:
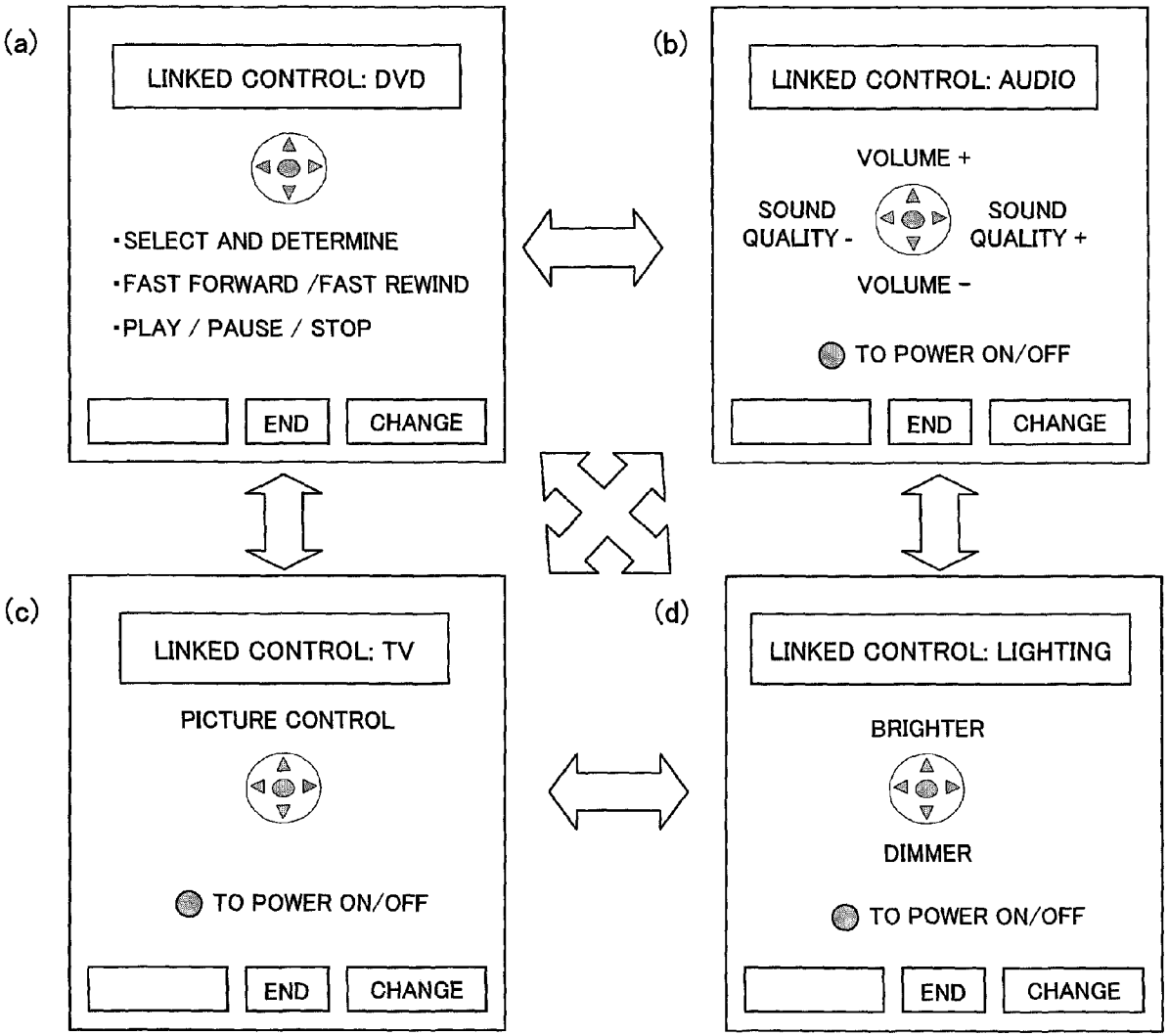
FIG. 19 is a diagram showing examples of screens in the linked control mode displayed on the display unit of the remote control apparatus according to the exemplary embodiment 2 of the present invention.

FIG. 19 is a diagram showing examples of screens in the linked control mode displayed on the display unit 103 of the remote control apparatus 10. FIG. 19 shows a situation where four interface programs respectively of "DVD player", "audio apparatus", "TV" and "lighting apparatus" are retrieved and switched as necessary.

The user performs desired remote control by operating the keys of the operation unit 104 of the remote control apparatus 10 (S1814). For example, in the situation where, by the linked control described above, the DVD player and the television are connected with each other and are in the power-on state, it is assumed that the operation unit 104 is set as an operation interface of "DVD player".

In this situation, the user may perform an operation corresponding to "play".

This user operation is transmitted from the operation unit 104 of the remote control apparatus 10 to the main control unit 101 via the interface control unit 106. The main control unit 101 identifies the control content operated by the user. The main control unit 101 generates control order data of the identified control content, and transmits it to the network control unit 20 via the wireless communication unit 108 (S1815). At that time, the control order data transmitted to the network control unit 20 includes address information identifying a control-object apparatus. Additionally, a control mode flag indicating the linked control mode is attached.

This control order data is received by the wireless communication unit 203 of the network control unit 20, and is transmitted to the control unit 201.

By the control mode flag attached to the control order data, the control unit 201 of the network control unit 20 identifies that the present control is in the linked control mode. Further, the control unit 201 identifies a control-object apparatus by address information included in the control order data (S1816).

Then, the control unit 201 transmits the control order data, via the routing unit 202 and the connection unit 205, to the apparatus to be controlled (S1817).

The control-object apparatus executes an operation designated in the received control order data (S1818).

The operations from S1814 to S1818 described above are repeated each time the user operates the keys of the operation unit 104 of the remote control apparatus 10.

As has been described above, in the linked control mode of the present exemplary embodiment, scenarios of linked control among a plurality of apparatuses can be set. Then, identified are a plurality of apparatuses whose images are captured by the user pointing the camera unit 102 of the remote control apparatus 10 at the apparatuses, as object apparatuses of the remote control, and linked control according to the combination of the apparatuses can be performed. Further, if the camera unit 102 is provided with a zoom function, object apparatuses can be captured in images from a distance. Accordingly, such linked control between apparatuses can be used also in a large meeting room, a small hall, an event site or the like.

Also in the present exemplary embodiment, a configuration of the remote control apparatus 10 may be such that, from among images displayed on the display unit 103 when the user points the camera unit 102 at a control-object apparatus, a square frame, for example, is superposed on an image which the camera unit 102 recognizes as a capturing target. Further, the step S1805 in FIG. 18 may include a step of lighting up a display means, including an LED, of an apparatus, on identifying the apparatus as a control-object apparatus by its acquired image.

Next, an exemplary embodiment 3 of the present invention will be described.

Figure 21:
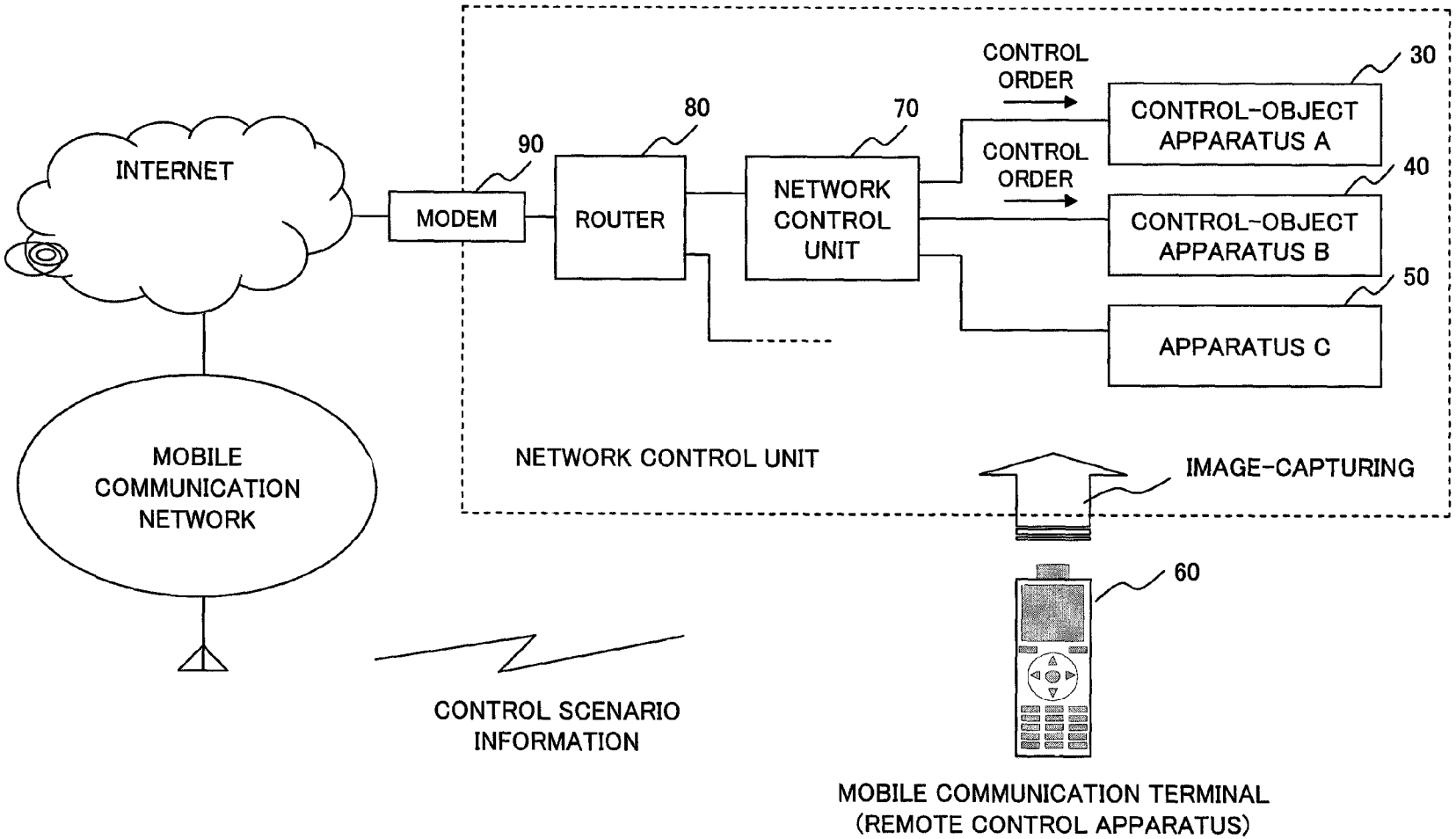
FIG. 21 is a block configuration diagram showing a system configuration according to an exemplary embodiment 3 of the present invention.

FIG. 21 is a block diagram showing a system configuration according to the exemplary embodiment 3 of the present invention.

In the exemplary embodiment 3, although control-object apparatuses are connected, as in the exemplary embodiment 2, to an internal network such as a local area network, a remote control apparatus 60 is in the form of being installed in a mobile communication terminal such as a mobile phone.

Accordingly, a network control unit 70 of the exemplary embodiment 3 does not need to communicate directly with the remote control apparatus 60, and communication between them is performed at least via a mobile communication network.

Figure 22:
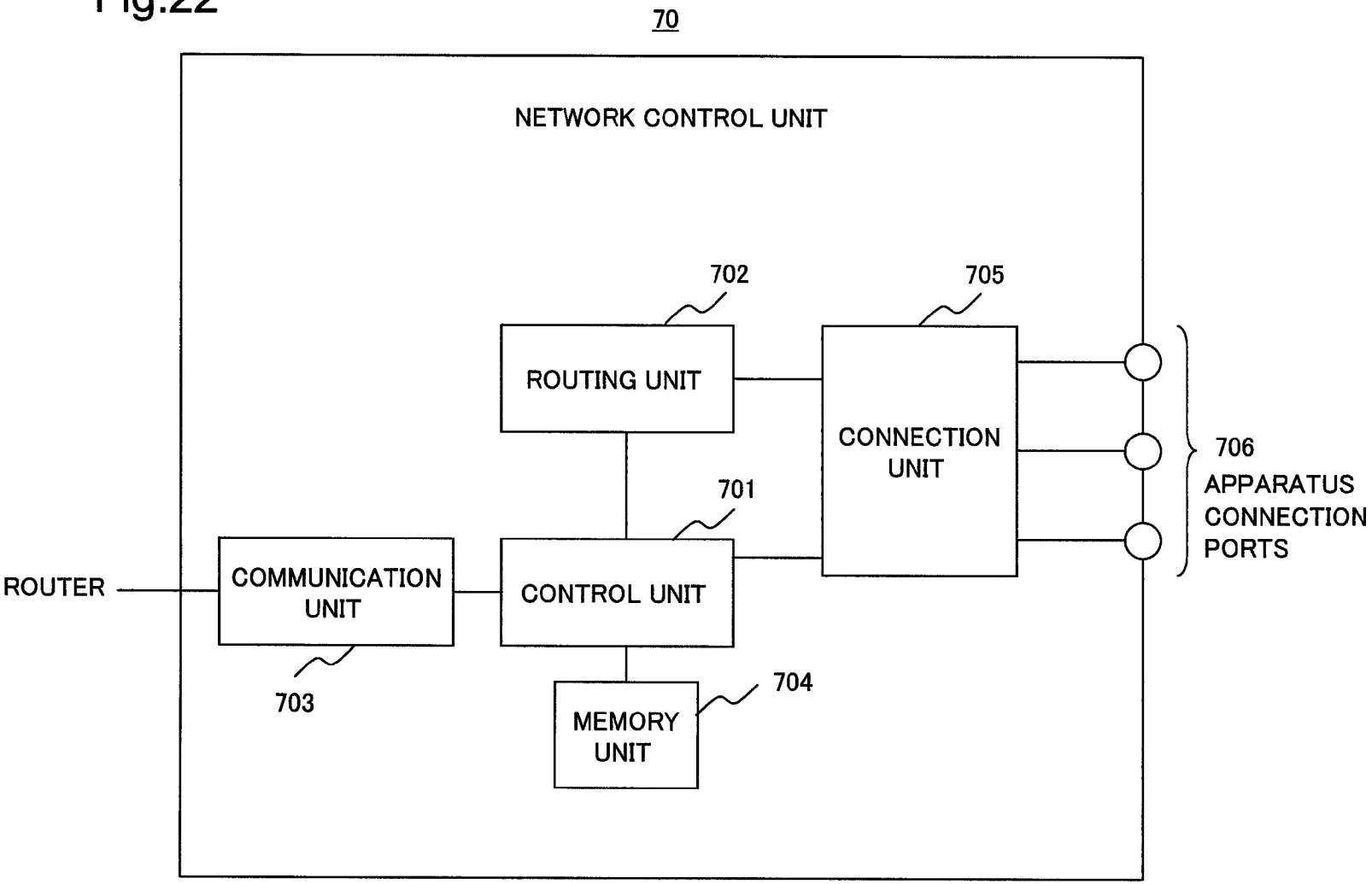
FIG. 22 is a block configuration diagram showing a configuration of a network control unit according to the exemplary embodiment 3 of the present invention.

FIG. 22 is a block diagram showing an example of a configuration of the network control unit according to the exemplary embodiment 3 of the present invention. The network control unit 70 has a configuration which is obtained by removing the wireless communication unit 203 from the network control unit 20 of the exemplary embodiment 2 shown in FIG. 8. Then, its communication with the remote control apparatus 60 is performed via a mobile communication network and the internet with an intervention of a router 80 constituting a local area network. Accordingly, as shown in FIG. 22, the network control unit 70 is equipped with a communication unit 703 capable of communicating with the router 80.

The other configurations and operation are the same as that described with respect to the exemplary embodiment 2, and a registration mode, a solitary control mode and a linked control mode are provided.

Also in the present exemplary embodiment, a configuration of the remote control apparatus 60 may be such that, from among images displayed on the display unit 103 when the user points the camera unit 102 at a control-object apparatus, a square frame, for example, is superposed on an image which the camera unit 102 recognizes as a capturing target. Further, it may be determined to light up a display means, including an LED, of an apparatus identified by a captured image.

The present exemplary embodiment 3 enables to use mobile phone communication for transmitting control information, and enables also to identify an apparatus installed in the distance when using a zoom function of the camera unit, and therefore, it fits the use at a widely opened place such as a temporary outdoor event site and a theme park.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

This application is based upon and claims the benefit of priority from Japanese patent application No. 2009-256909, filed on Nov. 10, 2009, the disclosure of which is incorporated herein in its entirety by reference.

Reference Signs List

10, 60 remote control apparatus
20, 70 network control unit
30, 40 control-object apparatus
50 apparatus
11 control-object apparatus identification means
12 control scenario output means
111 image comparison means
121 control scenario search means
13, 21 communication means
112 images for comparison
122, 25 control scenario registration information storage means
22 control scenario analysis means
23 control order data generation means
24 apparatus connection means
101 main control unit
102 camera unit
103 display unit
104 operation unit
105 camera control unit
106 interface control unit
107, 204 memory unit
108, 203 wireless communication unit
201, 701 control unit
202, 702 routing unit
205, 705 connection unit
206, 706 apparatus connection port
703 communication unit
80 router
90 modem

The invention claimed is:

1. A remote control system comprising: a remote control apparatus for identifying control-object apparatuses by capturing respective images of a plurality of apparatuses belonging to a desired control scenario and connected to a network, and for transmitting control scenario information concerning cooperative operation among a plurality of control-object apparatuses which are determined by a combination of types of the identified said control-object apparatuses; and a network control unit for constituting said network, by containing said plurality of apparatuses, and for, on receiving said control scenario information from said remote control apparatus, outputting, to said apparatuses prescribed in the received control scenario information, control orders for causing said apparatuses to execute operations prescribed in the received control scenario information.

2. The remote control system according to claim 1, wherein said remote control apparatus comprises:

an image comparison unit for identifying said control-object apparatuses by comparing said apparatuses each captured in an image with image information for comparison stored in the image comparison unit;

a control scenario information search unit for acquiring control scenario information determined by a combination of types of the identified said control-object apparatuses from control scenario registration information storing said control scenario information; and a communication unit for transmitting the acquired said control scenario information to the outside.

3. The remote control system according to claim 2, wherein said network control unit comprises:

a communication unit for receiving said control scenario information from the outside;

a control scenario analysis unit for analyzing said control-object apparatuses prescribed by said control scenario information and operation contents prescribed by said control scenario information for each control-object apparatus, and for outputting control-object apparatus information specifying each control-object apparatus and operation contents information for each control-object apparatus;

a control order data generation unit for generating and outputting control order data corresponding to each control-object apparatus, on the basis of said control-object apparatus information and said operation contents information transmitted from said control scenario analysis unit; and an apparatus connecting unit equipped with ports to connect respective ones of a plurality of said apparatuses, the apparatus connecting unit for, on the basis of said control order data outputted by said control order data generation unit, identifying said ports connecting respective ones of said control-object apparatuses and transmitting control order data corresponding to respective ones of said control-object apparatuses.

4. The remote control system according to claim 2, wherein:

said network control unit is equipped with a memory unit for storing apparatus type information, connection position information, and address information prescribed by said network, of said apparatuses connected to the network control unit, as connected device information; and said remote control apparatus is equipped with an image registration control unit for performing a process of registering captured images of said apparatuses as images for comparison, wherein the image registration control unit acquires said connected device information from said network control unit and registers the captured images of said apparatuses, relating them to said connected device information, as said images for comparison.

5. The remote control system according to claim 4, wherein said remote control apparatus is equipped with a control scenario registration control unit for performing a process of registering said control scenario information, wherein the control scenario registration control unit registers, for each control scenario, apparatus type information concerning a plurality of said control-object apparatuses participating corresponding control and operation information prescribed for each control-object apparatuses, along with control scenario identification information for identifying a corresponding control scenario, as said control scenario registration information, and transmits the registered control scenario registration information to said network control unit.

6. The remote control system according to claim 5, wherein said network control unit stores in said memory unit said control scenario registration information transmitted from said remote control apparatus, with said connection position information and said address information in said connected device information added to said apparatus type information concerning control-object apparatuses included in the control scenario registration information.

7. The remote control system according to claim 6, wherein:

said control scenario information search unit of said remote control apparatus outputs said control scenario identification information included in the acquired said control scenario information via said communication unit; and on receiving said control scenario identification information via said communication unit, said control scenario analysis unit of said network control unit retrieves said control scenario information corresponding to the said control scenario identification information from said control scenario registration information stored in said memory unit, and analyzes said control-object apparatuses and operation contents for each of the control-object apparatuses prescribed by the retrieved control scenario information.

8. The remote control system according to claim 3, wherein said communication unit of said remote control apparatus communicates with said communication unit of said network control unit directly or via a mobile communication network.

9. A remote control apparatus for remotely controlling a plurality of apparatuses contained in a network control unit, the remote control apparatus comprising:

a control-object apparatus identification unit for capturing respective images of a plurality of said apparatuses belonging to a desired control scenario, and thereby identifying apparatuses to control; and a control scenario output unit for outputting control scenario information prescribing operations of each apparatus in cooperative operation among a plurality of control-object apparatuses which are determined by a combination of types of the identified said control-object apparatuses, wherein, receiving said control scenario information, said network control unit causes said control-object apparatuses to execute operations prescribed by the control scenario information.

10. The remote control apparatus according to claim 9, wherein:

said control-object apparatus identification unit comprises an image comparison unit for comparing said apparatuses captured in images with image information for comparison it stores, and thereby identifying said control-object apparatuses; and said control scenario output unit comprises a control scenario information search unit for acquiring control scenario information determined by a combination of types of the identified said control-object apparatuses from control scenario registration information storing said control scenario information, and a communication unit for transmitting the acquired said control scenario information to the outside.

11. The remote control apparatus according to claim 10, further comprising an image registration control unit for performing a process of registering captured images of said apparatuses as images for comparison, wherein said image registration control unit acquires, from said network control unit, connected apparatus information stored in said network control unit, including apparatus type information, connection position information, and address information prescribed by said network, of said apparatuses connected to the network control unit, and registers the captured images of said apparatuses as said images for comparison, relating them to said connected apparatus information.

12. The remote control apparatus according to claim 11, further comprising a control scenario registration control unit for performing a process of registering said control scenario information, wherein the control scenario registration control unit registers, for each control scenario, apparatus type information concerning a plurality of said control-object apparatuses participating corresponding control and operation information prescribed for each control-object apparatus, along with control scenario identification information for identifying a corresponding control scenario, as said control scenario registration information, and transmits the registered control scenario registration information to said network control unit.

13. The remote control apparatus according to claim 12, wherein, on acquiring said control scenario information, said control scenario information search unit outputs either said control scenario identification information or type information concerning said control-object apparatuses and operation information prescribed for each control-object apparatus, which are included in the control scenario information, via said communication unit.

14. The remote control apparatus according to claim 10, wherein said communication unit communicates with said network control unit directly or at least via a mobile communication network.

15. A remote control method comprising the steps of:

capturing by a remote control apparatus respective images of a plurality of apparatuses belonging to a desired control scenario and connected to a network control unit, and thereby identifying control-object apparatuses by the remote control apparatus;

transmitting control scenario information concerning cooperative operation among a plurality of control-object apparatuses determined by a combination of types of the identified said control-object apparatuses by said remote control apparatus; and outputting by said network control unit, to the apparatuses prescribed by the received said control scenario information, control orders causing the apparatuses to execute operations prescribed by the received said control scenario information.

16. The remote control method according to claim 15, wherein said capturing and identifying step includes comparing said apparatuses captured in images with stored image information for comparison to identify said control-object apparatuses; and said transmitting step includes acquiring, from control scenario registration information storing said control scenario information, control scenario information determined by a combination of types of the identified said control-object apparatuses, and transmitting the acquired said control scenario information to the outside.

17. The remote control method according to claim 16, wherein said outputting step comprises:

receiving said control scenario information from the outside;

analyzing said control-object apparatuses prescribed by said control scenario information and operation contents prescribed by said control scenario information for each control-object apparatus, and outputting control-object apparatus information identifying each control-object apparatus and operation contents information for each control-object apparatus;

generating and outputting control order data corresponding to each control-object apparatus, on the basis of said control-object apparatus information and said operation contents information outputted at said analyzing step; and , on the basis of said control order data outputted at said generating and outputting step, identifying ports connecting respective ones of said control-object apparatuses and transmitting control order data corresponding to respective ones of said control-object apparatuses.

18. The remote control method according to claim 17, further comprising:

storing type information, connection position information, and address information prescribed by said network, of said apparatuses connected to said network control unit, as connected device information; and registering images of said apparatuses captured by said remote control apparatus as said images for comparison, wherein said registering step includes acquiring said connected device information from said network control unit, and registering the captured images of said apparatuses as said images for comparison, relating them to said connected device information.

19. The remote control method according to claim 18, further comprising registering said control scenario information by said remote control apparatus, wherein said registering step includes:

registering, for each control scenario, apparatus type information concerning a plurality of said control-object apparatuses participating corresponding control and operation information prescribed for each control-object apparatus, along with control scenario identification information identifying a corresponding control scenario, as said control scenario registration information; and transmitting the registered control scenario registration information also to said network control unit.

20. The remote control method according to claim 19, further comprising storing said control scenario registration information transmitted from said remote control apparatus by said network control unit, with said connection position information and said address information stored in said storing step added to apparatus type information concerning said control-object apparatuses included in the control scenario registration information.

21. The remote control method according to claim 20, wherein:

said acquiring step includes outputting said control scenario identification information included in the acquired said control scenario information; and said analyzing step includes retrieving said control scenario information corresponding to the received said control scenario identification information from said control scenario registration information, and analyzing said control-object apparatuses and operation contents for each of the control-object apparatuses prescribed by the retrieved control scenario information.

* * * * *